US007003240B2

(12) United States Patent
Omoto et al.

(10) Patent No.: US 7,003,240 B2
(45) Date of Patent: Feb. 21, 2006

(54) INDUCTION-HEATING FIXING APPARATUS AND IMAGE FORMING APPARATUS

(75) Inventors: Tetsuko Omoto, Hachioji (JP); Naohiko Hanyu, Hachioji (JP); Miho Toyoda, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 85 days.

(21) Appl. No.: 10/848,623

(22) Filed: May 18, 2004

(65) Prior Publication Data

US 2005/0013622 A1 Jan. 20, 2005

(30) Foreign Application Priority Data

Jul. 14, 2003 (JP) ..... 2003-196477
Mar. 2, 2004 (JP) ..... 2004-057725

(51) Int. Cl.
*G03G 15/20* (2006.01)

(52) U.S. Cl. ..... 399/69; 219/619

(58) Field of Classification Search ..... 399/67, 399/69; 219/216, 219
See application file for complete search history.

(56) References Cited

U.S. PATENT DOCUMENTS

| | | | | |
|---|---|---|---|---|
| 6,097,905 | A * | 8/2000 | Watanabe et al. | 399/69 |
| 6,181,891 | B1 * | 1/2001 | Higashi et al. | 399/69 |
| 6,243,547 | B1 * | 6/2001 | Mizuno et al. | 399/69 |
| 6,782,216 | B1 * | 8/2004 | Suzuki | 399/69 |
| 6,850,728 | B1 * | 2/2005 | Yokozeki et al. | 219/216 |
| 2002/0011485 | A1 * | 1/2002 | Suzuki | 219/619 |
| 2003/0068169 | A1 * | 4/2003 | Suzuki | 399/69 |
| 2005/0031364 | A1 * | 2/2005 | Hayashi | 399/69 |

FOREIGN PATENT DOCUMENTS

| | | |
|---|---|---|
| JP | 2000-206813 | 7/2000 |
| JP | 2002-023557 | 1/2002 |
| JP | 2002-124369 | 4/2002 |

* cited by examiner

*Primary Examiner*—Susan Lee
(74) *Attorney, Agent, or Firm*—Lucas & Mercanti LLP

(57) ABSTRACT

An induction-heating fixing apparatus comprising: a heating member for fixing a toner image to a recording material carrying the toner image by heating the toner image; an induction-heating coil divided into a plurality of coils and comprising a first induction-heating coil and a second induction-heating coil adjacent to each other; and a power-distribution control member for controlling power distribution by supplying a driving-current to the plurality of induction-heating coils in order to heat the heating member, wherein the power-distribution control member comprises a determining section for selecting whether to supply the driving-current to the first induction-heating coil or the second induction-heating coil.

18 Claims, 12 Drawing Sheets

INDUCTION-HEATING FIXING APPARATUS AND IMAGE FORMING APPARATUS

BACKGROUND OF THE INVENTION

1. Field of the Invention

The present invention relates to an induction-heating fixing apparatus and an image forming apparatus having the induction-heating fixing apparatus such as a copying machine, printer, or facsimile, particularly to power-distribution control of an induction-heating fixing apparatus using an induction-heating system.

2. Description of Related Art

An image forming apparatus is provided with a fixing apparatus for fixing a toner image on a recording material by heating the toner image. An induction-heating fixing apparatus using an induction-heating system has is provided with a heating member in which an induction-heating coil is set as a heating source and a pressuring member for forming a nip portion by pressure-contacting with the heating member. The heating member uses a heating roller or a heating belt, and a mold release layer is formed on the surface of a conductive base substance.

The induction-heating coil is wound into a length corresponding to the maximum passing-sheet width of a recording material, which must heat the entire region of a heating roller wider than the maximum passing-sheet width at the time of warm-up or standby. Moreover, when passing a recording material having a width smaller than the maximum passing-sheet width, there is a problem that the temperature of the no-passing-sheet portion of a heating roller rises. To solve the problem, a conventional method of dividing an induction-heating coil into a plurality of coils and arranging the coils is disclosed.

For example, a method of controlling the temperature of an induction-heating roller for controlling a current or voltage to be supplied to each of the divided plurality of induction-heating coils in accordance with an output of a temperature sensor in order to shorten the rise time for raising a heating roller up to a fixable temperature and obtain the uniformity and temporal stability of set temperatures of various portions of the roller is disclosed (JP-Tokukaisho-57-128373A).

Moreover, a high-frequency heating fixing method of dividing a coil into a plurality of coils and winding the coils on an iron core so as not to raise the temperature of the no-passing-sheet portion of a fixing member, selecting a coil for passing a current in accordance with the size of a toner-image support body (recording material), and changing induction-heating regions, is disclosed (JP-Tokukaisho-58-178385A).

Like the above-described prior art, when the driving-control of supply currents is performed independently with respect to each of a plurality of induction-heating coils which is divided and arranged, induction-heating coils can be simultaneously driven or not simultaneously driven in accordance with a change of operation modes or passing-sheet sizes of an image forming apparatus.

When a high-frequency current flows through an induction-heating coil constituted by a copper wire, the coil is influenced by a magnetic field to cause minute vibrations. When a characteristic such as an inductance or capacitor capacitance of an induction-heating coil or heating roller differs, the frequency of a current supplied from a power supply becomes a different frequency. Because of such factor, when adjacent induction-heating coils are simultaneously driven, currents of different frequencies flow through the adjacent induction-heating coils, thereby minute vibrations are generated, and large vibrations are generated due to overlap of the minute vibrations. Moreover, there are problems that a heating roller and the like are resonated due to the vibrations and noises such as resonant sounds are generated.

However, when each of the induction-heating coils is not driven along with each other, the temperature of a heating member may be lowered due to the loss time when the heating member is not heated by the induction-heating coil. The temperature drop causes a fixing trouble, causes the temperature rise speed of the heating member to lower, and a trouble occurs that a warm-up time WUT (time until the heating member reaches a fixable temperature) is increased. Therefore, it is requested to perform power distribution control to each induction-heating coil with no loss time when the heating material is heated.

However, because a maximum rated current (e.g. 15[A]) is set to an image forming apparatus, a maximum current usable for a fixing apparatus is restricted in accordance with operation modes of apparatus portions other than a fixing apparatus such as image forming mode, warm-up mode, or standby mode.

Therefore, for the power distribution control of a fixing apparatus, it is requested to avoid induction-heating coils from being simultaneously driven, and to perform finer control by corresponding to operation modes of apparatus portions other than the fixing apparatus in an image forming apparatus and by considering the current supply balance between the induction-heating coils.

SUMMARY OF THE INVENTION

The present invention is in the view of the above-mentioned problems. An object of the present invention is to realize the power distribution control capable of efficiently heating a heating member and minimizing the temperature fluctuation of the heating member, while securing a maximum current which can be obtained in a current restriction applied to a fixing apparatus in an image forming apparatus, in addition to preventing vibrations and noises from being generated in an induction-heating coil.

To solve the above problem, according to a first aspect of the present invention, an induction-heating fixing apparatus comprises:

a heating member for fixing a toner image to a recording material carrying the toner image by heating the toner image;

an induction-heating coil divided into a plurality of coils and comprising a first induction-heating coil and a second induction-heating coil adjacent to each other; and a power-distribution control member for controlling power distribution by supplying a driving-current to the plurality of induction-heating coils in order to heat the heating member, wherein the power-distribution control member comprises a determining section for selecting whether to supply the driving-current to the first induction-heating coil or the second induction-heating coil.

According to the first aspect of the present invention, it is possible to restrain vibrations of an induction-heating coil and prevent uncomfortable noises from being generated by determining whether to distribute power to either of a plurality of adjacent induction-heating coils but not distributing power to the adjacent induction-heating coils at the same time.

Preferably, the driving-currents to be supplied to the plurality of induction-heating coils have the same current value each other.

According to the above invention, it is easy to perform control so as not to exceed a usable maximum current by equalizing driving-currents to be supplied to a plurality of induction-heating coils.

Preferably, the apparatus further comprises:

a first temperature sensor for detecting a temperature of the heating member corresponding to the first induction-heating coil; and a second temperature sensor for detecting a temperature of the heating member corresponding to the second induction-heating coil, wherein the determining section selects the first induction-heating coil or the second induction-heating coil in accordance with detection temperatures detected by the first temperature sensor and the second temperature sensor.

According to the above invention, because power distribution to each induction-heating coil is stepwise changed by distributing power in accordance with each detected temperature, it is possible to stepwise and slowly raise the temperature of the region of a heating member corresponding to first and second induction-heating coils and efficiently heat the heating member.

Preferably, the power-distribution control member controls supply of the driving-current to each of the induction-heating coils adjacent to each other so as to raise the driving-current to be supplied to one of the adjacent induction-heating coils when the driving-current to be supplied to the other of the adjacent induction-heating coils falls.

According to the above invention, it is possible to efficiently and continuously heat a heating member with no time loss by starting supply of a driving-current to one induction-heating coil when the current falls after stopping supply of a driving-current to the other induction-heating coil and moreover, quickly raise the temperature of the heating member to a fixable temperature.

Preferably, the apparatus further comprises:

a first temperature sensor for detecting a temperature of the heating member corresponding to the first induction-heating coil; and a second temperature sensor for detecting a temperature of the heating member corresponding to the second induction-heating coil, wherein the power-distribution control member performs control so as to adjust a time for supplying the driving-current to each of the induction-heating coils in accordance with a change rate of a detection temperature detected by each of the temperature sensors.

According to the above invention, it is possible to prevent a supply current caused by power distribution from being excessive or insufficient by changing a driving-current supply time in accordance with a change rate of temperatures.

Preferably, the apparatus further comprises:

a first temperature sensor for detecting a temperature of the heating member corresponding to the first induction-heating coil; and a second temperature sensor for detecting a temperature of the heating member corresponding to the second induction-heating coil, wherein the power-distribution control member performs control so as to adjust a rate of a time for supplying the driving-current to each of the induction-heating coils in accordance with a difference between a predetermined target temperature and a detection temperature detected by each of the temperature sensors.

According to the above invention, it is possible to prevent a supply current caused by power distribution from being excessive or insufficient by changing a driving-current supply time in accordance with a difference between detected temperatures.

According to a second aspect of the present invention, an induction-heating fixing apparatus comprises:

a heating member for fixing a toner image to a recording material carrying the toner image by heating the toner image;

an induction-heating coil divided into a plurality of coils and comprising a first induction-heating coil and a second induction-heating coil adjacent to each other; and a power-distribution control member for controlling power distribution by supplying a driving-current to the plurality of induction-heating coils in order to heat the heating member, wherein the power-distribution control member performs control so as not to supply the driving-current to the second induction-heating coil when the driving-current is supplied to the first induction-heating coil or so as not to supply the driving-current to the first induction-heating coil when the driving-current is supplied to the second induction-heating coil.

According to the second aspect of the present invention, vibrations of an induction-heating coil are restrained by selecting any one of adjacent induction-heating coils to which power should be distributed so as not to distribute power to the adjacent induction-heating coils at the same time. It is possible to restrain vibrations of an induction-heating coil and prevent uncomfortable noises from being generated.

According to a third aspect of the present invention, an image forming apparatus comprises:

an image carrying body for carrying a toner image;

a transfer member for transferring the toner image carried by the image carrying body to a recording material; and an induction-heating fixing apparatus for fixing the toner image to the recording material carrying the toner image, the induction-heating fixing apparatus comprising a heating member for fixing the toner image to the recording material carrying the toner image by heating the toner image, an induction-heating coil divided into a plurality of coils and comprising a first induction-heating coil and a second induction-heating coil adjacent to each other, and a power-distribution control member for controlling power distribution by supplying a driving-current to the plurality of induction-heating coils in order to heat the heating member, wherein the power-distribution control member comprises a determining section for selecting whether to supply the driving-current to the first induction-heating coil or the second induction-heating coil.

According to the third aspect of the present invention, it is possible to restrain vibrations of an induction-heating coil and prevent comfortable noises by selecting one of adjacent induction-heating coils to which power should be distributed so as not to distribute power to the adjacent induction-heating coils at the same time.

Preferably, the driving-currents to be supplied to the plurality of induction-heating coils have the same current value each other.

According to the above invention, it is easy to perform control so as not to exceed a usable maximum current by equalizing driving-currents to be supplied to a plurality of induction-heating coils.

Preferably, the apparatus further comprises:

a first temperature sensor for detecting a temperature of the heating member corresponding to the first induction-heating coil; and a second temperature sensor for detecting a temperature of the heating member corresponding to the second induction-heating coil, wherein the determining section selects the first induction-heating coil or the second induction-heating coil based on detection temperatures detected by the first temperature sensor and the second temperature sensor.

According to the above invention, the power distribution to each induction-heating coil is stepwise changed by controlling power distribution in accordance with each detected temperature and it is possible to stepwise raise the temperature of the region of a heating member corresponding to first and second induction-heating coils and efficiently heat the heating member.

Preferably, the power-distribution control member controls supply of the driving-current to each of the induction-heating coils adjacent to each other so as to raise the driving-current to be supplied to one of the adjacent induction-heating coils when the driving-current to be supplied to the other of the adjacent induction-heating coils falls.

According to the above invention, it is possible to efficiently and continuously heat a heating member with no time loss by starting supply of a driving-current to one induction-heating coil when a current falls after stopping supply of a driving-current to the other induction-heating coil and moreover, it is possible to quickly raise the temperature of the heating member to a fixable temperature.

Preferably, the apparatus further comprises:

a first temperature sensor for detecting a temperature of the heating member corresponding to the first induction-heating coil; and a second temperature sensor for detecting a temperature of the heating member corresponding to the second induction-heating coil, wherein the power-distribution control member performs control so as to adjust a time for supplying the driving-current to each of the induction-heating coils in accordance with a change rate of a detection temperature detected by each of the temperature sensors.

According to the above invention, it is possible to prevent an excessive or insufficient supply-current state caused by power distribution, and to heat a heating member efficiently.

Preferably, the apparatus further comprises:

a first temperature sensor for detecting a temperature of the heating member corresponding to the first induction-heating coil; and a second temperature sensor for detecting a temperature of the heating member corresponding to the second induction-heating coil, wherein the power-distribution control member performs control so as to adjust a rate of a time for supplying the driving-current to each of the induction-heating coils in accordance with a difference between a predetermined target temperature and a detection temperature detected by each of the temperature sensors.

According to the above invention, it is possible to prevent an excessive or insufficient supply-current state caused by a difference between detected temperatures by changing driving-current supply times in accordance with a difference between detected temperatures.

Preferably, the driving-currents to be supplied to the plurality of induction-heating coils are changed in accordance with an operation mode of the image forming apparatus.

According to the above invention, it is possible to perform control so as not to exceed a maximum current and efficiently use the power which can be used even when operation modes are changed.

Preferably, the operation mode comprises at least a plurality of operation modes selected out of an image forming mode, a standby mode, and an energy saving mode.

According to the present invention, it is possible to perform control so as not to exceed a maximum current by changing driving-currents used in accordance with each operation mode and efficiently use the power which can be used even when operation modes are changed.

Preferably, the power-distribution control member performs control so as to supply the driving-current, which is determined in advance corresponding to a passing-sheet size of the recording material, to each of the induction-heating coils.

According to the above invention, it is possible to supply an optimum power every passing-sheet width, uniformly heat a heating member, and moreover shorten a heating time, and realize efficient heating.

Preferably, the power-distribution control member performs control so as to adjust a time for supplying the driving-current, which is determined in advance corresponding to a passing-sheet size of the recording material, to each of the induction-heating coils.

According to the above invention, it is possible to uniformly keep the temperature of a heating member, shorten a heating time, and realize efficient heating by changing driving-current supply times in accordance with the passing-sheet size of a recording material.

According to a fourth aspect of the present invention, an image forming apparatus comprises:

an image carrying body for carrying a toner image;

a transfer member for transferring the toner image carried by the image carrying body to a recording material; and an induction-heating fixing apparatus for fixing the toner image to the recording material carrying the toner image, the induction-heating fixing apparatus comprising a heating member for fixing the toner image to the recording material carrying the toner image by heating the toner image, an induction-heating coil divided into a plurality of coils and comprising a first induction-heating coil and a second induction-heating coil adjacent to each other, and a power-distribution control member for controlling power distribution by supplying a driving-current to the plurality of induction-heating coils in order to heat the heating member, wherein the power-distribution control member performs control so as not to supply the driving-current to the second induction-heating coil when the driving-current is supplied to the first induction-heating coil or so as not to supply the driving-current to the first induction-heating coil when the driving-current is supplied to the second induction-heating coil.

According to the fourth aspect of the present invention, vibrations of an induction-heating coil are restrained by selecting any one of adjacent induction-heating coils to which power should be distributed so as not to distribute power to the adjacent induction-heating coils at the same time. Thus, it is possible to restrain vibrations of an induction-heating coil and prevent uncomfortable noises.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein.

PREFERRED EMBODIMENTS OF THE INVENTION

Hereinafter, the embodiment of the present invention will be described referring to FIG. 1 to FIG. 13.

[Embodiment 1]

<Configuration of Image Forming Apparatus>

Figure 1:
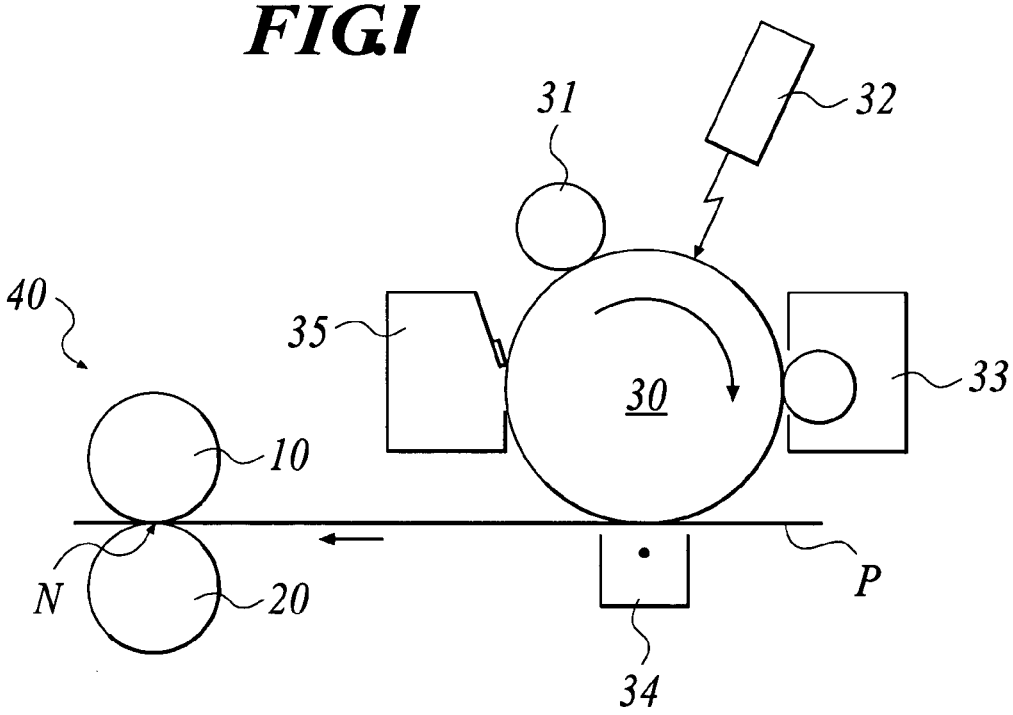
FIG. 1 is a schematic block diagram of an image forming apparatus 1 in embodiment 1.

FIG. 1 shows a schematic configuration of an image forming apparatus 1 of embodiment 1 of the present invention.

An image forming apparatus of the present invention comprises an image carrying body for carrying a toner image, a transfer member for transferring the toner image carried by the image carrying body to a recording material, and an induction-heating fixing apparatus for fixing the toner image to the recording material carrying the toner image by heating the toner image. As the image carrying body, a photosensitive body or an intermediate transfer body are used.

Minutely, as shown in FIG. 1, the image forming apparatus 1 of the present embodiment 1 comprises a photoconductor drum 30 as the image carrying body. The surface of the photoconductor drum 30 is electrified to a predetermined potential by an electrifier 31, an electrostatic latent image is formed on the surface of the photoconductor drum 30 by exposing an image by an exposure member 32, the latent image is visualized as a toner image by using a developer made from toner and carrier and thereby developing the latent image by a development counter 33, and the obtained toner image is transferred to a recording material P such as paper carried to the photoconductor drum 30 by a transfer member 34. The photoconductor drum 30 completing the transfer of the toner image removes the remaining toner from the surface of the drum 30 by a cleaner 35 and then, the remaining toner is used to form the next image.

The recording material P carrying the toner image is sent from the photoconductor drum 30 to an induction-heating fixing apparatus 40, the unfixed toner image on the recording material P is fixed by the induction-heating fixing apparatus 40, and an image is formed on the recording material P.

An induction-heating fixing apparatus of the present invention comprises a heating member for fixing a toner image to a recording material carrying the toner image by heating the toner image, a pressuring member for forming a nip portion N by pressure-contacting with the heating member, an induction-heating coil for performing induction heating which is provided in the heating member, and the like. As the heating member, it is possible to use a heating belt, a heating roller or the like. However, it is preferable to use the heating roller because it is superior in heat efficiency. Moreover, as the pressuring member, it is possible to use a pressure roller, a pad or the like. However, it is preferable to use the pressure roller. The induction-heating fixing apparatus 40 in FIG. 1 comprises a heating roller 10 serving as the heating member, a pressure roller 20 serving as the pressuring member for forming the nip portion N by pressure-contacting with the heating roller 10, and an induction-heating coil for performing the induction heating which is provided in the heating roller 10. A toner image on the recording material P is fixed by passing through the nip portion N where the heating roller 10 and pressure roller 20 are pressure-contacted.

Figure 2:
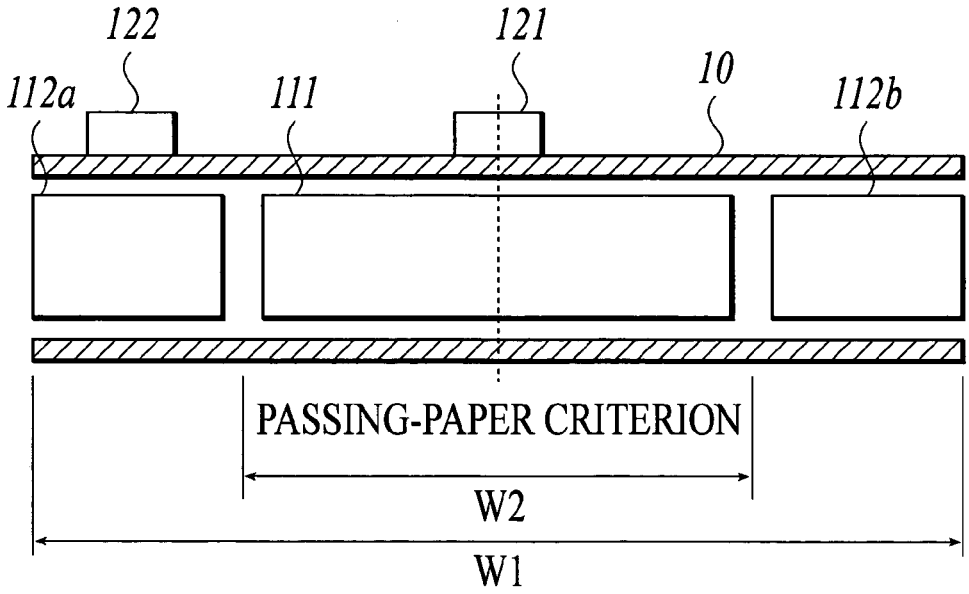
FIG. 2 is a longitudinal sectional view of a heating roller 10.

FIG. 2 shows a longitudinal sectional view of the heating roller 10.

As shown in FIG. 2, the passing-sheet criterion of the induction-heating fixing apparatus 40 is set to the center of the heating roller 10. In the heating roller 10, from one end to the other end in the axial direction, a second induction-heating coil 112*a* is placed at one end of the heating roller 10, a first induction-heating coil 111 is placed at the central portion of the heating roller 10, and a second induction-heating coil 112*b* is placed at the other end of the heating roller 10 by forming a predetermined gap in the axial direction of the heating roller 10.

The first induction-heating coil 111 is used as a heating source in the region of the heating roller 10 with a passing-sheet width (W2) when, for example, the A4 sized recording material P is fixed under the state in which the longitudinal direction and the passing-sheet direction of the recording material P are parallel each other. The first induction-heating coil 111 and the second induction-heating coils 112*a* and 112*b* are used as the heating sources in the region of the heating roller 10 with a passing-sheet width (W1) when, for example, the A4 sized recording material P is fixed under the state in which the longitudinal direction and the passing-sheet direction of the recording material P are perpendicularly crossed each other.

Moreover, a non-contact or contact temperature detection member is placed on the outer periphery of the heating roller 10. That is, a first temperature sensor 121 and a second temperature sensor 122 serving as the temperature sensors for detecting the temperatures of the regions of the heating roller 10 on which an induction field works are set to positions facing the induction-heating coils 111, 112*a*, and 112*b*.

Because driving-currents are supplied from the same power supply section to the second induction-heating coils

112*a* and 112*b* dividedly arranged at the both ends of the heating roller 10, it is considered that temperature distributions of the second induction-heating coils 112*a* and 112*b* are the same each other. Therefore, the second temperature sensor 122 is set to a position facing any one of the second induction-heating coils 112*a* and 112*b*.

As the first temperature sensor 121 and the second temperature sensor 122, a temperature sensor such as a thermistor, a thermocouple, or an infrared sensor can be used. Further, not to limited to the above, it is possible to use any sensor as long as the sensor can detect the temperature of the heating roller 10 or the temperature of a position nearby the heating roller 10.

Figure 3:
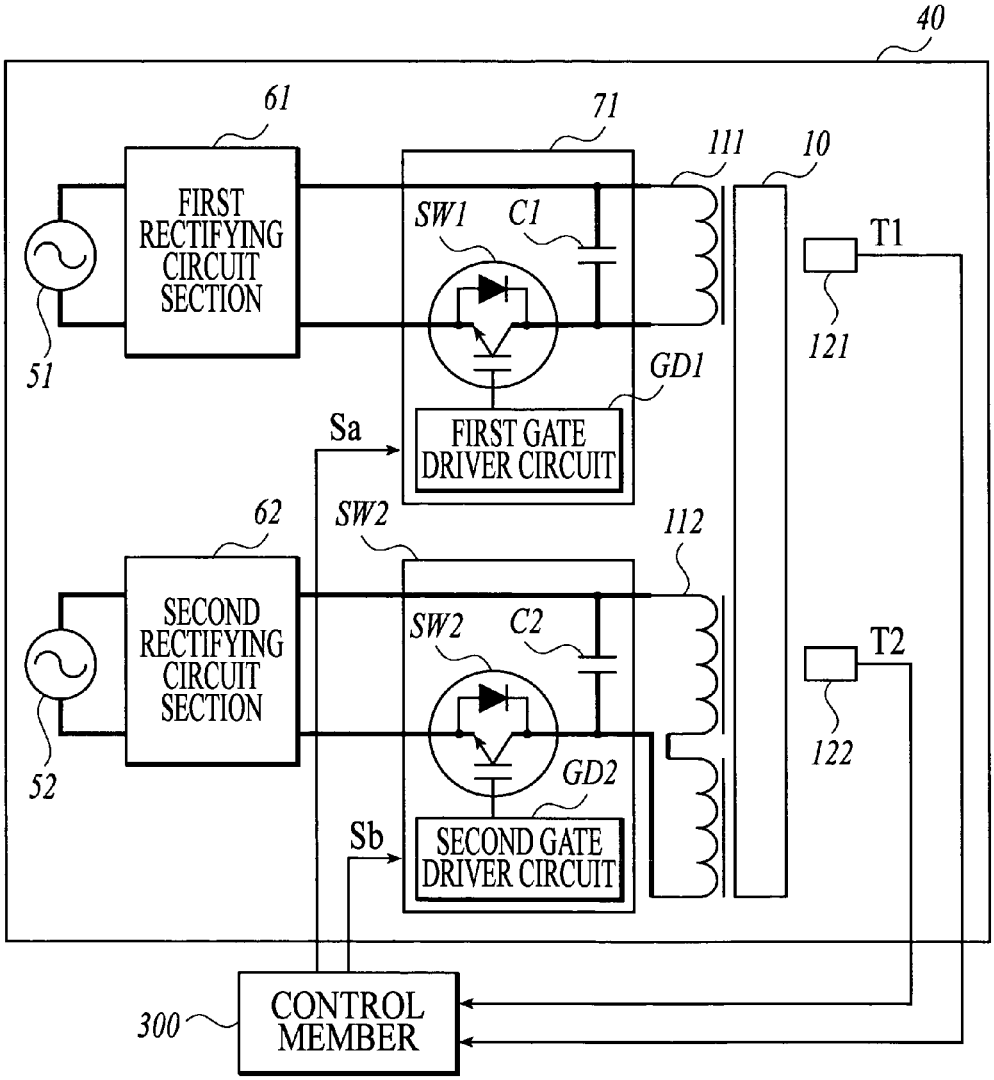
FIG. 3 is a control block diagram of an induction-heating fixing apparatus 40.

FIG. 3 shows a control block diagram of the induction-heating fixing apparatus 40.

As shown in FIG. 3, the induction-heating fixing apparatus 40 comprises: an apparatus system comprising the first induction-heating coil 111, the second induction-heating coils 112*a* and 112*b*, the heating roller 10 or the like; a first AC power-supply section 51 and a second AC power-supply section 52 as driving power-supply sections; a first rectifying-circuit section 61 and a second rectifying-circuit section 62; a first IH (Induction Heating) circuit section 71 and a second IH circuit section 72; and the first temperature sensor 121 and the second temperature sensor 122 for respectively detecting the temperature of the heating roller 10. The induction-heating fixing apparatus 40 is controlled by a control member 100 comprising the power-distribution control member for performing the power-distribution control to the first induction-heating coil 111 and the second induction-heating coils 112*a* and 112*b*.

The first rectifying-circuit section 61 converts the alternating current supplied from the first AC power-supply section 51 into a direct current and outputs the direct current to the first IH circuit section 71. The second rectifying-circuit section 62 converts the alternating current supplied from the second AC power-supply section 52 into a direct current and outputs the direct current to the second IH circuit section 72.

The first IH circuit section 71 comprises a first capacitor C1 for always supplying a constant-high-frequency current to the first induction-heating coil 111, which is in parallel with the first induction-heating coil 111, a first switching device SW1 for turning on/off the current to be supplied to the first induction-heating coil 111, and a first gate driver circuit GD1 for operating the first switching device. Moreover, the first IH circuit section 71 is a circuit for distributing the direct current supplied from the first rectifying-circuit section 61 to the first induction-heating coil 111 to convert the current into a high-frequency current for generating an induction field, wherein the first gate driver circuit GD1 operates the first switching device SW1 based on a first power-distribution control signal Sa input from the control member 100 to supply the driving-current to the first induction-heating coil 111.

The second IH circuit section 72 comprises a second capacitor C2 for always supplying a constant-frequency direct current to the second induction-heating coils 112*a* and 112*b*, which is in parallel with the second induction-heating coils 112*a* and 112*b*, a second switching device SW2 for turning on/off the current to be supplied to the second induction-heating coil 122, and a second driver circuit GD2 for operating the second switching device SW2. Moreover, the second IH circuit section 72 is a circuit for converting the direct current supplied from the second rectifying-circuit section 62 into a high-frequency current for generating an induction field in the second induction-heating coil 112, wherin the second gate driver circuit GD2 operates the second switching device SW2 based on a power-distribution control signal Sb input from the control member 100 to supply the driving-current to the second induction-heating coils 112*a* and 112*b* dividedly arranged at the both ends when.

It is possible to use a switching device such as an IGB (Insulated Gate Bipolar Transistor) as the first switching device SW1 and the second switching device SW2.

The first temperature sensor 121 detects the temperature (first detection temperature T1) of the heating roller 10 facing the first induction-heating coil 111. The detected first detection temperature T1 is output to the control member 100.

In the same way, the second temperature sensor 122 detects the temperature (second detection temperature T2) of the heating roller 10 facing the second induction-heating coil 112*a*. The detected second detection temperature T2 is output to the control member 100.

Figure 4:
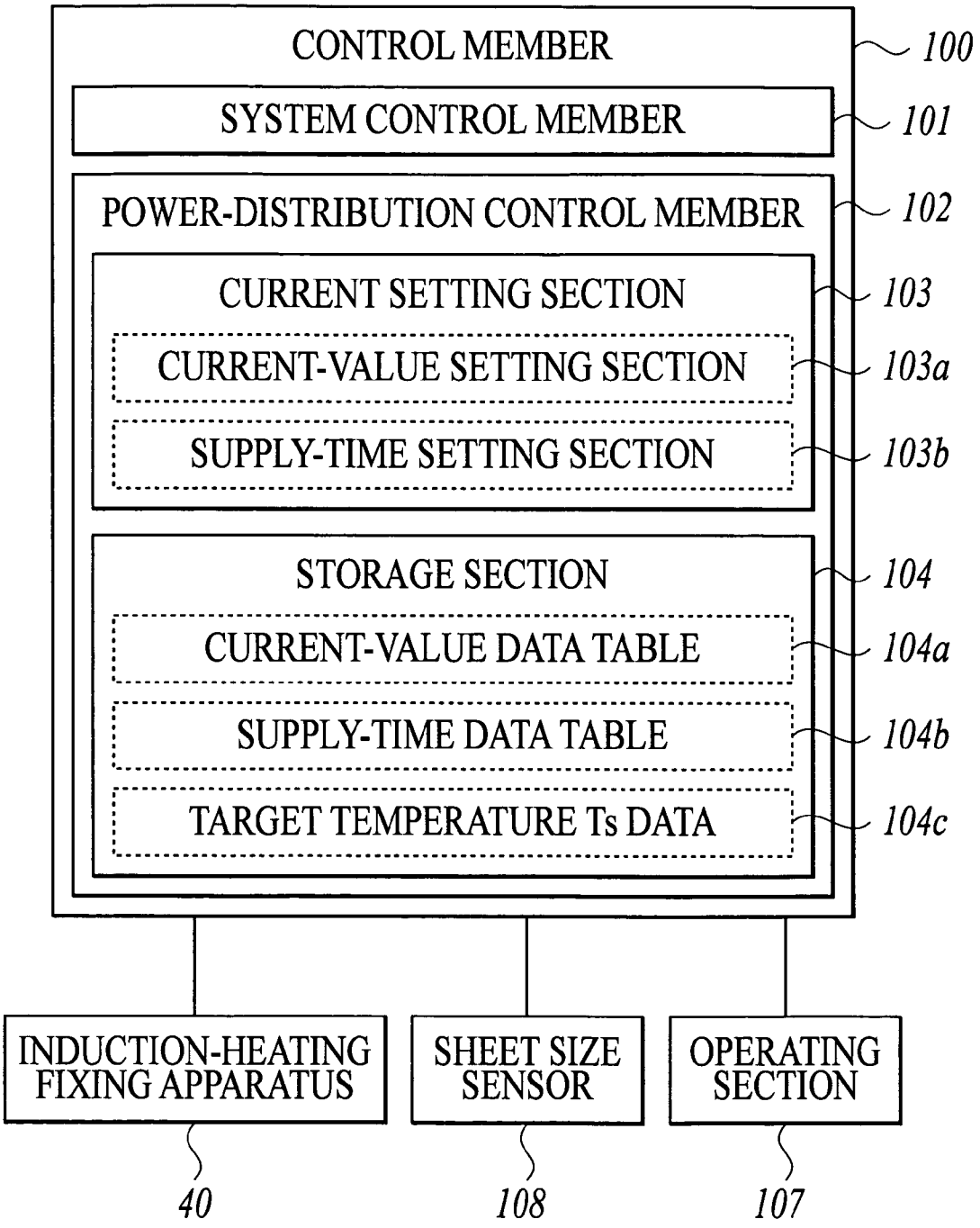
FIG. 4 is a block diagram of control member 100 of the embodiment 1.

FIG. 4 shows a block diagram of the control member 100 of the present embodiment.

The control member 100 of the present invention constitutes a system control member 101, a power-distribution control member 102, a current setting section 103, and a storage section 104 with a CPU (Central Processing Unit), a ROM (Read Only Memory), and a RAM (Random Access Memory)or the like, which are not shown.

The ROM of the control member 100 previously stores a program and data corresponding to the image forming apparatus 1. As the program and the data, a system program, various processing programs corresponding to the present system, and data necessary to be processed by the various processing programs are stored.

The RAM of the control member 100 serves as a temporary storage region for programs, input data, output data, and parameters read from the ROM or the like in various processings controlled and executed by the CPU.

The system control member 101 reads the system program, the various processing programs and the data stored in the ROM, develops the programs and the data in the RAM. Accordingly, the system control member 101 performs the central control of the operations of each section of the image forming apparatus 1 in accordance with the developed programs. As the contents of the control by the system control member 101, the timing control of the whole system, the storage and accumulation control of the image data by using the RAM, the image processing (such as changing magnification, filtering, and Y conversion) of the image data sent from a scanner section or the like, the output of the image data to a printer section, the input/output control of an operating section 107, and the control of the interface (I/F) and the operation of other applications (FAX, printer, scanner, or the like), can be cited.

The current setting section 103 comprises a current setting section 103*a* and a supply-time setting section 103*b*. The storage section 104 stores a current-value data table 104*a*, a supply-time data table 104*b*, and target-temperature Ts data 104*c* of the heating roller 10.

Moreover, the control member 100 is connected to the operating section 107 for selecting the size of the recording material P to be passed, and to a sheet size sensor 108, which is provided in the sheet feed tray, for detecting the size of the recording material P to be passed. The control member 100 determines the passing-sheet region (hereafter referred to as the passing-sheet width) of the recording material P in the axial direction of the heating roller 10 based on a passing-sheet-size signal sent from the operating section 107 or a passing-sheet-size signal sent from the sheet size sensor 108.

When the whole region of the heating roller, that is, the region of the passing-sheet width W2 is heated by the first induction-heating coil 111 and second induction-heating coils 112*a* and 112*b*, the power-distribution control member 102 of the present invention performs the control so as to supply the driving-current only to one of the induction-heating coils without simultaneously supplying the driving-currents to the first induction-heating coil 111 and the second induction-heating coils 112*a* and 112*b* adjacent to each other. That is, when it is necessary to simultaneously supply the driving-currents to both the first induction-heating coil 111 and the second induction-heating coils 112*a* and 112*b* adjacent to each other, the region of each heating roller is slowly heated by performing the controls which are alternately changed over.

The above term "alternately" means "substantially alternately". Therefore, in addition to the case where the controls are always changed over each other, the case where the driving-current is continuously supplied to one of the adjacent induction-heating coils and thereafter, the driving-current is supplied to the other of the induction-heating coils, is included. Further, the case where it is difficult that the currents circulating through the adjacent induction-heating coils are completely alternately changed over and there is a time when the currents circulate through the both induction-heating coils at fall and rise times, is included.

The power-distribution control member 102 reads out the current-value setting section 103*a* and the supply-time setting section 103*b* set in the current setting section 103. Then the power-distribution control member 102 sets the current values to be supplied to the first induction-heating coil 111 and the second induction-heating coils 112*a* and 112*b*, based on the current-value data table 104*a* in the storage section 104 and the conditions such as the voltage and the frequency of an AC power-supply section. Further, the power-distribution control member 102 sets the supply time of the current based on the supply-time data table 104*b*. Moreover, the power-distribution control member 102 compares the first detection temperature T1 detected by the first temperature sensor 121 with the second detection temperature T2 detected by the second temperature sensor 122 by a determination section to be described later to determine and select the induction-heating coil having a lower detection temperature. Then, the power-distribution control member 102 compares the detection temperature of the selected induction-heating coil with the target temperature Ts. When the detection temperature is equal to or lower than the target temperature Ts, the power-distribution control member 102 supplies the driving-current to the selected induction-heating coil. When the detection temperature exceeds the target temperature Ts, the power-distribution control member 102 returns to the original state.

It is allowed that the power-distribution control member 102 is a specific power-distribution control member included in the induction-heating fixing apparatus 40. It is also allowed that the power-distribution control member is the member included in the control member which is connected with each section in the apparatus so that various information can be transferred to and from each section and which receives the information from each section, determines the received information, outputs the information such as an operation designation as the determination result, and controls each section.

<Control Operation of Driving Current>

Next, the operations of the present embodiment 1 will be described below.

Figure 5:
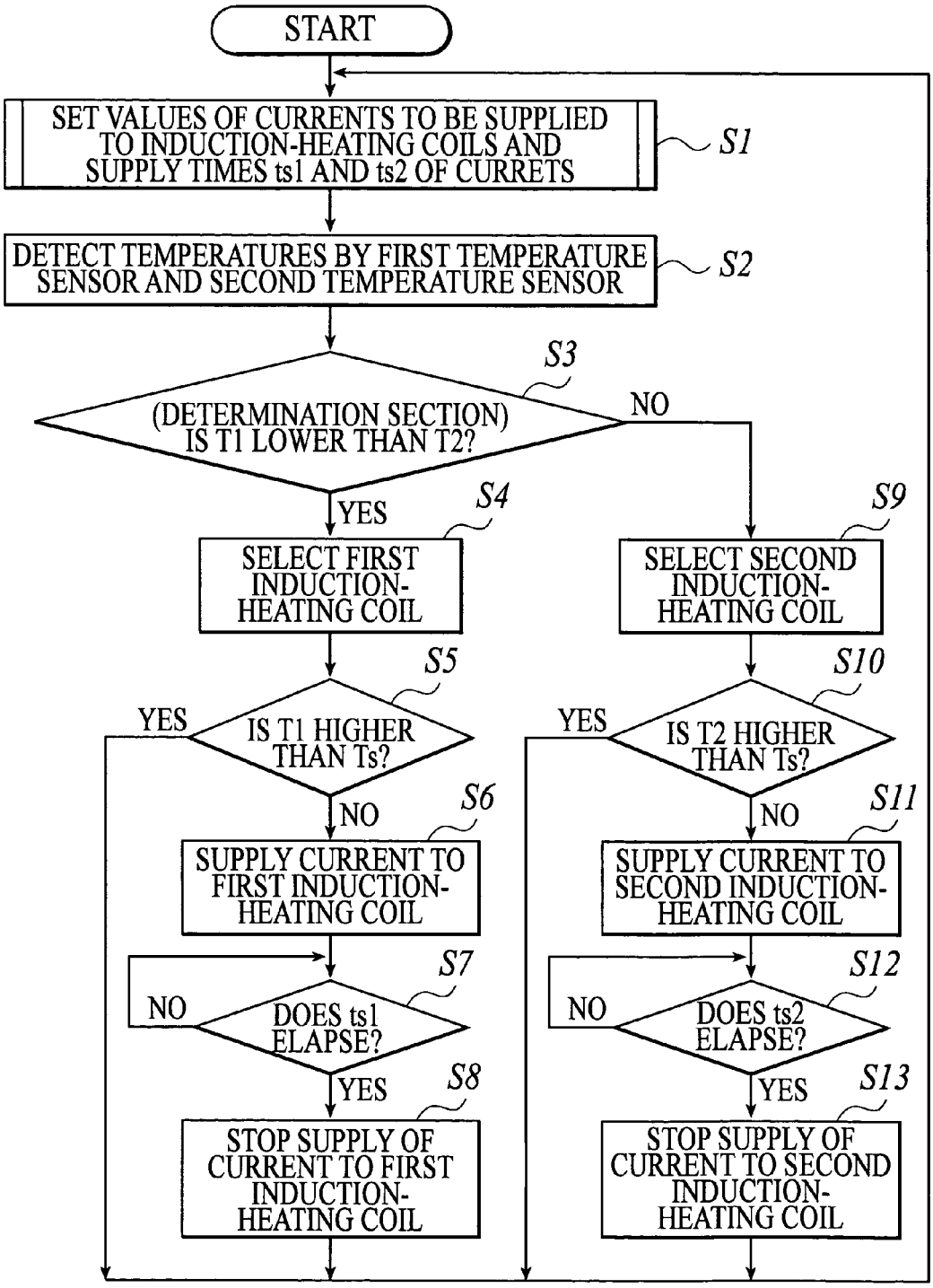
FIG. 5 is a control operation flow of a driving-current supplied to an induction-heating coil in the embodiment 1.

FIG. 5 shows a flow of control operations of the driving-current to be supplied to an induction-heating coil of the present embodiment 1.

First, the current values to be supplied to the induction-heating coils and the supply times ts1 and ts2 of the currents are set (step S1). Then, the first detection temperature T1 and the second detection temperature T2 are detected by the first temperature sensor 121 and the second temperature sensor 122, and input to the control member 100 (step S2). Then, the determination section compares the input first detection temperature T1 with the input second detection temperature T2, and determines whether to select the first induction-heating coil 111 or the second induction-heating coils 112*a* and 112*b* (step S3). When it is determined by the determination section that the first detection temperature T1 is lower than the second detection temperature T2 (YES in step S3), the first induction-heating coil 111 is selected (step S4). It is determined whether the first detection temperature T1 detected by the first temperature sensor 121 is higher than the target temperature Ts (step S5).

When it is determined that the first detection temperature T1 is not higher than the target temperature Ts (NO in step S5), the first power-distribution control signal Sa is output to the first IH circuit 71 so as to supply the driving-current to the first induction-heating coil 111, the driving-current is supplied to the first induction-heating coil 111 (step S6), and the driving-current having a predetermined value is supplied for a predetermined time ts1. When the predetermined time ts1 elapses (YES in step S7), the first power-distribution control signal Sa is output to the first IH circuit section 71 so as to stop the supply of the driving-current to the first induction-heating coil 111, the supply of the driving-current to the first induction-heating coil 111 (step S8), and the original step S1 is restarted.

When it is determined that the first detection temperature T1 is higher than the target temperature Ts (YES in step S5), the original step S1 is restarted.

However, when the first detection temperature T1 is compared with the second detection temperature T2 by the determination section in step S3 and it is determined that the first detection temperature T1 is lower than the second detection temperature T2 (NO in step S3), the control of power distribution to the second induction-heating coils 112*a* and 112*b* is selected (step S9). It is determined whether the second detection temperature T2 detected by a second temperature sensor 122 is higher than the target temperature Ts (step S10).

When the second detection temperature T2 is equal to or lower than the target temperature Ts (NO in step S10), the second power-distribution control signal Sb is output to the second IH circuit 72 so as to supply the driving-current to the second induction-heating coils 112*a* and 112*b*, the driving-current is supplied to the second induction-heating coils 112*a* and 112*b* (step S11), and the driving-current having a predetermined value is supplied for a predetermined time ts2. When the predetermined time ts2 elapses (YES in step S12), the second power-distribution signal Sb is output to the second IH circuit section 72 so as to stop the supply of the driving-current to the second induction-heating coils 112*a* and 112*b*, the supply of the driving-current to the second induction-heating coils 112*a* and 112*b* is stopped (step S13), and the original step S1 is restarted.

When it is determined that the second detection temperature T2 is higher than the target temperature Ts (YES in step S10), the original step S1 is restarted.

It is allowed that the predetermined times ts1 and ts2 are equal to each other or differently set every operation mode of the image forming apparatus.

By distributing power to any one of the first induction-heating coil 111 and the second induction-heating coils 112*a* and 112*b* adjacent to each other so as not to simultaneously distribute power to both the coils in accordance with the detection temperature sent from the temperature sensor placed so as to face each induction-heating coil, it is possible to restrain vibrations of the induction-heating coils and prevent uncomfortable noises. Further, by controlling power distribution based on the target temperature and each of detection temperatures, it is possible to stepwise raise the temperature of the region of the heating roller 10 corresponding to the first induction-heating coil 111 and the second induction-heating coils 112*a* and 112*b*. Consequently, it is possible to efficiently heat the heating roller 10.

Moreover, when the temperature distribution in the whole axial direction of the heating roller 10 is uniformed, it is preferable that the same current values are set in the current-value data table 104*a* as the values of the driving-currents to be supplied to the first induction-heating coil 111 and the second induction-heating coils 112*a* and 112*b*. By equalizing the driving-currents to be supplied to the induction-heating coils, it is easy to perform the control so as not to exceed a usable maximum current.

Next, the current switching operation of the present embodiment 1 will be described below.

When the driving-currents to be supplied to the plurality of induction-heating coils are alternately changed over, a fixing trouble may occur because the WUT extends or the fixing temperature of the heating roller lowers during copying if the driving-current is not supplied to any induction-heating coil. Therefore, when the currents are changed almost alternately, the rise time and the fall time of the current value are set so that the times become equal to each other.

Figure 6:
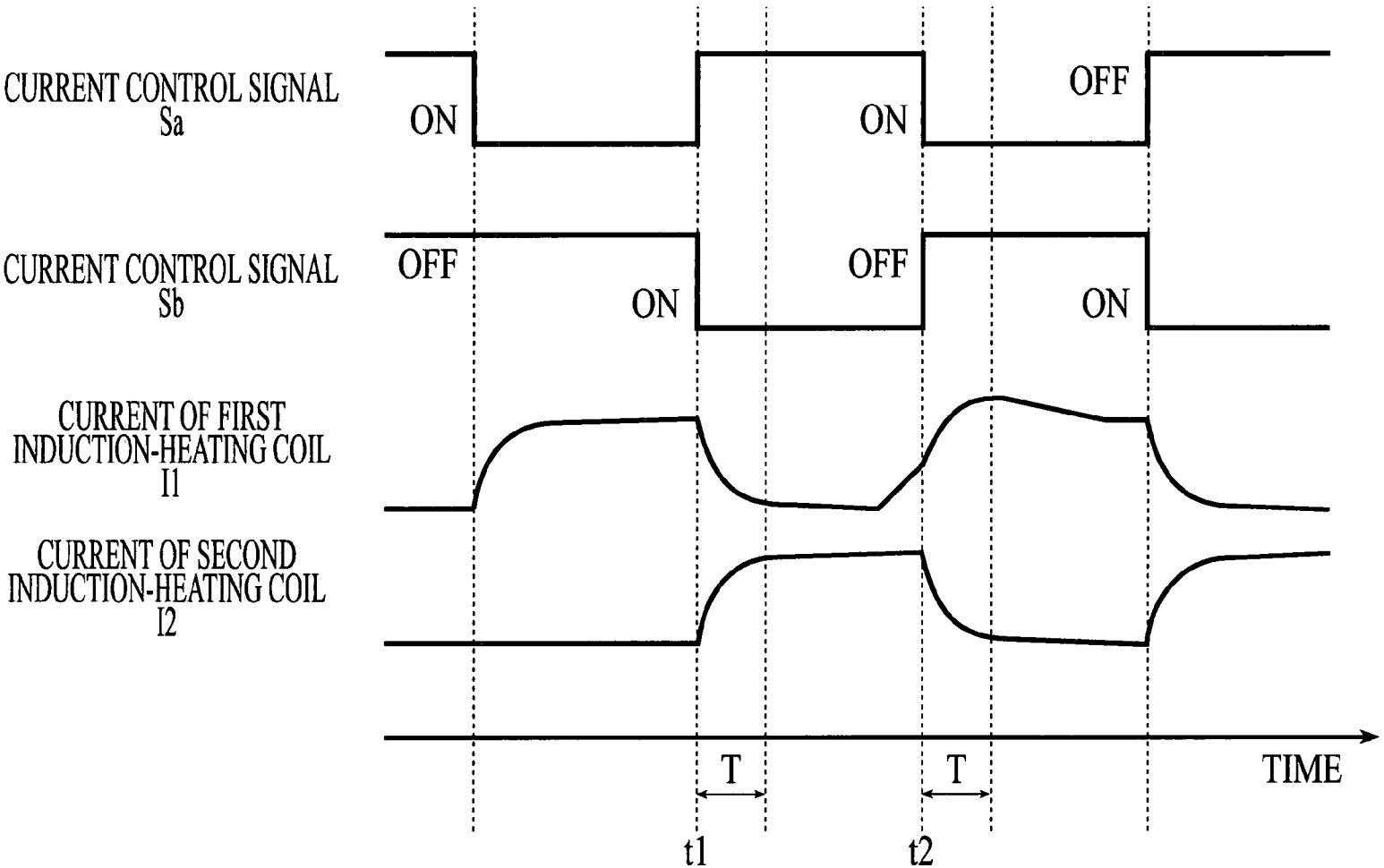
FIG. 6 is an example of a timing chart between a first power-distribution control signal Sa, a second power-distribution control signal Sb, a first current I1 and a second current I2 in the embodiment 1.

FIG. 6 shows an example of a timing chart between the first power-distribution control signal Sa, the second power-distribution control signal Sb, and a first current I1 and a second current I2 respectively circulating through the first induction-heating coil 111 and the second induction-heating coils 112*a* and 112*b*, in the present embodiment.

As shown in FIG. 6, when the first current I1 is supplied to the first induction-heating coil 111 as the driving-current in accordance with the first and second power-distribution control signals Sa and Sb, the control is performed so that the second current I2 serving as the driving-current is not supplied to the second induction-heating coil 112*a* or 112*b*. Moreover, when the second current I2 serving as the driving-current is supplied to the second induction-heating coils 112*a* and 112*b*, the control is performed so that the first current I2 serving as the driving-current is not supplied to the first induction-heating coil 111. Thus, the control is performed so that driving-currents to be supplied to the first induction-heating coil 111 and the second induction-heating coils 112*a* and 112*b* adjacent to each other are alternately changed over.

At the time t1 when the first power-distribution control signal Sa is turned off, the supply of the current to the first induction-heating coil 111 is stopped and the first current I1 falls. At the same time, the second current supply signal Sb is turned on, the supply of the current to the second induction-heating coils 112*a* and 112*b* is started, and the second current I2 rises. Moreover, at the time t2 when the first power-distribution control signal Sa is turned on and at the same time the second power-distribution control signal Sb is turned off, the time T when the first current I1 falls and the time T when the second current I2 rises are the same each other.

It is possible to set the time T when the first current I1 falls and the time T when the second current I2 rises being the same each other by designing the numbers of turns of the first induction-heating coil 111 and the second induction-heating coils 112*a* and 112*b* and the sectional areas and resistance values of lead wires to set a proper inductance.

Moreover, it is possible to use a method for stepwise changing the currents flowing at the time T when the first current I1 falls and the time T when the second current I2 rises.

By alternately supplying the driving-currents to the plurality of induction-heating coils adjacent to each other so that the time T when the first current I1 falls and the time T when the second current I2 rises become the same value, it is possible to prevent that the driving-current is not supplied to both of the induction-heating coils adjacent to each other. Then, it is possible to heat the heating roller 10 efficiently and continuously with no time loss. Moreover, it is possible to quickly raise the temperature of the heating roller 10 to a fixable temperature.

[Embodiment 2]

Because the configuration of an image forming apparatus 1 and a longitudinal cross section of the heating roller 10 of the present embodiment 2 are the same as those of the embodiment 1, it is omitted to illustrate and describe them. Moreover, the control configuration of an induction-heating fixing apparatus 40 of the embodiment 2 is the same as that of the embodiment 1 except that a control member 200 is provided instead of the control member 100. Therefore, it is omitted to illustrate and describe the control configuration.

Figure 7:
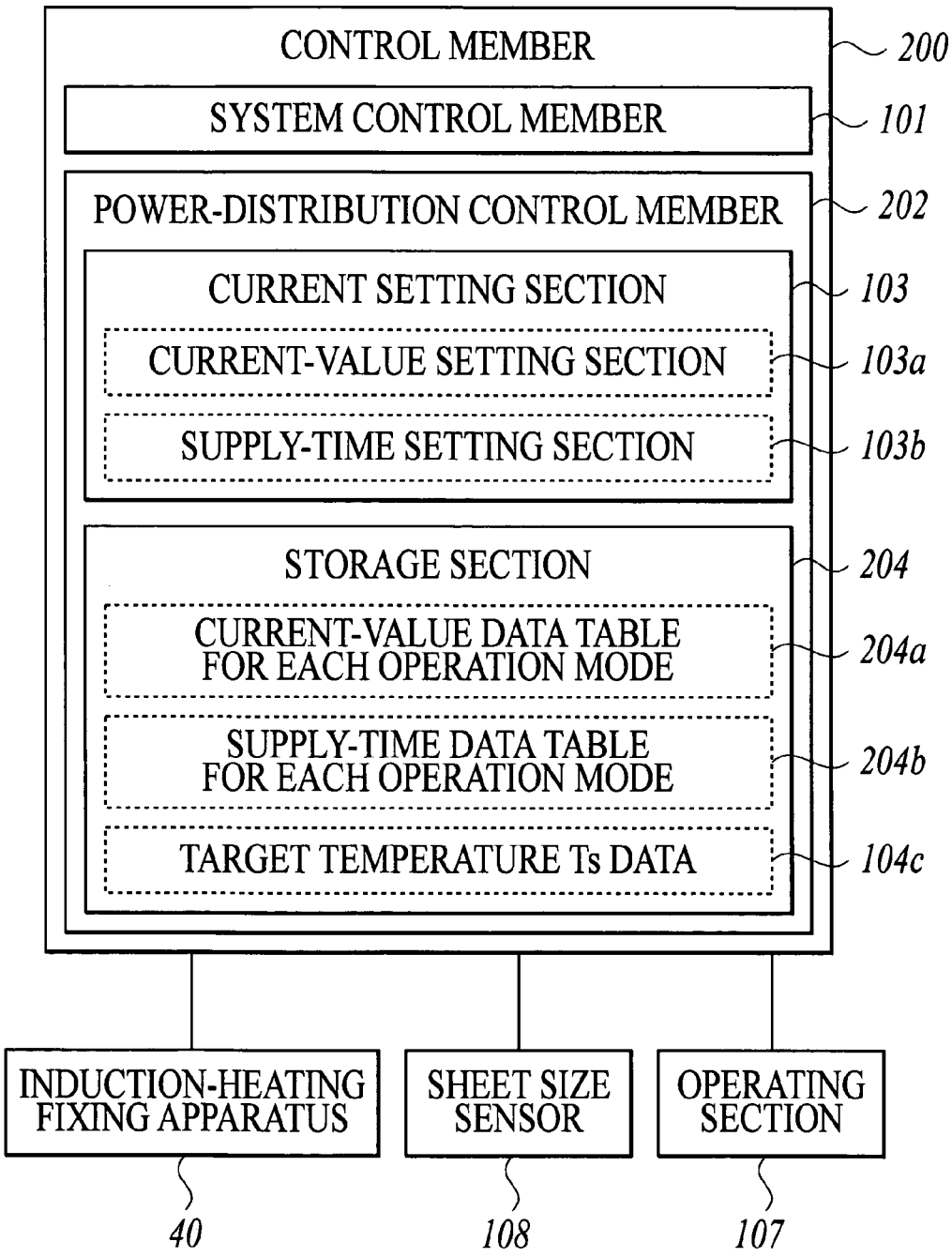
FIG. 7 is a control block diagram of control member 200 of embodiment 2.

FIG. 7 shows a control block diagram of the control member 200 of the present embodiment 2.

In FIG. 7, the configuration of the control member 200 of the embodiment 2 is the same as the configuration of the control member 100 of the embodiment 1 except that a current-value data table 204*a* for each operation mode and a supply-time data table 204*b* for each operation mode are stored in a storage section 204 of a power-distribution control member 202. Therefore, it is omitted to describe the configuration.

The power-distribution control member 202 reads out the current-value setting section 103*a* and the supply-time setting section 103*b* set in a current setting section 103. Then the power-distribution control member 202 sets the current values to be supplied to the fist induction-heating coil 111 and the second induction-heating coils 112*a* and 112*b*, based on the current-value data table 204*a* for each operation mode in the storage section 204 and conditions such as the voltage and frequency of an AC power-supply section. Further, the power-distribution control member 202 sets the supply time of the current based on the supply-time data table 204*b* for each operation mode. Moreover, the power-distribution control member 202 compares the first detection temperature T1 with the second detection temperature T2 to determine and select an induction-heating coil having a low detection temperature, and performs power-distribution control in accordance with the target temperature Ts.

The image forming apparatus 1 of the present embodiment 2 comprises at least a plurality of operation modes selected out of an image forming mode, a warm-up mode, and a standby mode.

Among the above-described operation modes, the "image forming mode" means a state in which an image is formed on a recording material P by an image forming apparatus, the "warm-up mode" means a state in which the temperature of the heating roller is raised up to a fixable temperature, and the "standby mode" means a state in which image formation has not been performed for a certain time or more and an image forming operation is stopped.

<Control Operation of Driving Current>

Next, the operations of the present embodiment 2 will be described below.

A control operation flow of the driving-current to be supplied to the induction-heating coil in the present embodiment 2 is a flow formed by adding subroutines for the current-value setting and the supply-time setting to step S1 in the flow in FIG. 5 shown in the embodiment 1. Then a basic flow other than the above flow is the same as the flow in FIG. 5, the description of the basic flow is omitted.

<Current-Value Setting and Supply-Time Setting>

Because a maximum current value usable in the image forming apparatus 1 is decided, the current value which can be supplied to the induction-heating coil of the induction-heating fixing apparatus 40 depends on the operation mode of the image forming apparatus 1 such as the image forming mode, the warm-up mode, or the standby mode. For example, in the case of the warm-up mode, it is necessary to increase the current to be supplied to the induction-heating coil compared to the case of other units because the temperature of the heating roller must be quickly raised. Moreover, in the case of the standby mode, the current value which can be supplied to the induction-heating coil is increased because the current value to be supplied to the motor of a sheet feed roller for forming an image and an exposure lamp is small. On the other hand, in the case of the image forming mode, the current value which can be supplied to the induction-heating coil is decreased because the current is supplied to the motor of a sheet feed roller and an exposure lamp. Therefore, the current value is set so that the same current is supplied to each of the plurality of induction-heating coils based on the operation mode of the image forming apparatus 1.

Figure 8:
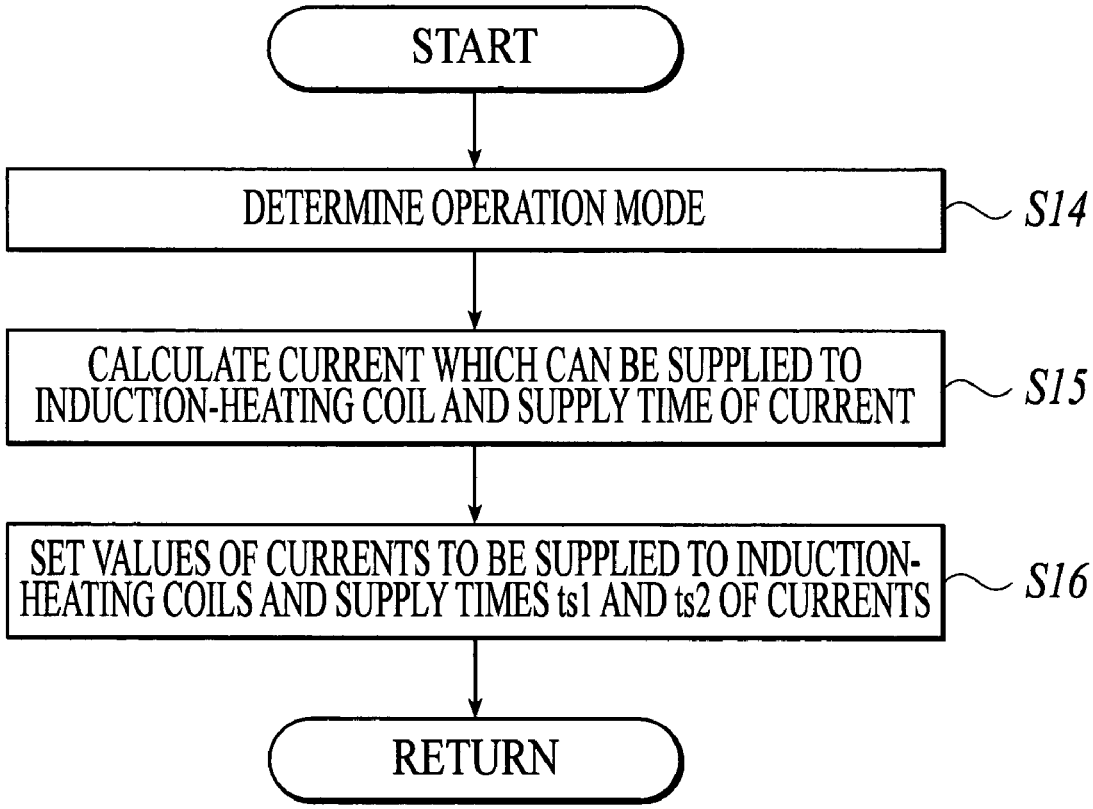
FIG. 8 is an operation flow for current-value setting and supply-time setting in the embodiment 2.

FIG. 8 shows an operation flow for the current-value setting and the supply-time setting in the present embodiment 2.

First, the information on the voltage and the frequency of the power supply section of the image forming apparatus 1 are obtained, and the present operation mode of the image forming apparatus 1 is determined (step S14). The current value which can be supplied to the induction-heating coil and the supply time of the current are calculated by referring to the obtained information on the power supply section, determined the operation mode, and the current values and supply times of the currents respectively stored in the current-value data table 204*a* for each operation mode and the supply-time data table 204*b* for each operation mode (step S15). The current values in which the driving-currents to be supplied to the first induction-heating coil 111 and the second induction-heating coils 112*a* and 112*b* are the same each other, and the supply times ts1 and ts2 of the currents are set based on the calculated current value and the calculated supply time of the current (step S16). Thereby, the driving-current is supplied to the first induction-heating coil 111 and the second induction-heating coils 112*a* and 112*b* based on the current value set by considering the operation mode.

Thus, by setting the current value for each operation mode, it is possible to prevent the current to be supplied for each operation mode from being excessive or insufficient. Further, as for the current value to be supplied, it is possible to alternately supply an optimum current value which can be supplied within a maximum current value usable for the image forming apparatus 1 to the plurality of induction-heating coils selected. Moreover, it is possible to effectively use the power which can be used even if the operation mode is changed.

[Embodiment 3]

Because the configuration of an image forming apparatus 1, a longitudinal cross section of the heating roller 10, and the control configuration of an induction-heating fixing apparatus 40 of the present embodiment 3 are the same as those of the embodiment 2, it is omitted to illustrate and describe them.

<Control Operation of Driving Current>

Next, the operations of the present embodiment 3 will be described below.

A control operation flow of the driving-current to be supplied to the induction-heating coil in the present embodiment 3 is a flow formed by adding subroutines for the current-value setting and the supply-time setting to step S1 in the flow in FIG. 5 shown in the embodiment 1. Then a basic flow other than the above flow is the same as the flow in FIG. 5, the description of the basic flow is omitted.

<Current Value Setting and Supply Time Setting>

Figure 9:
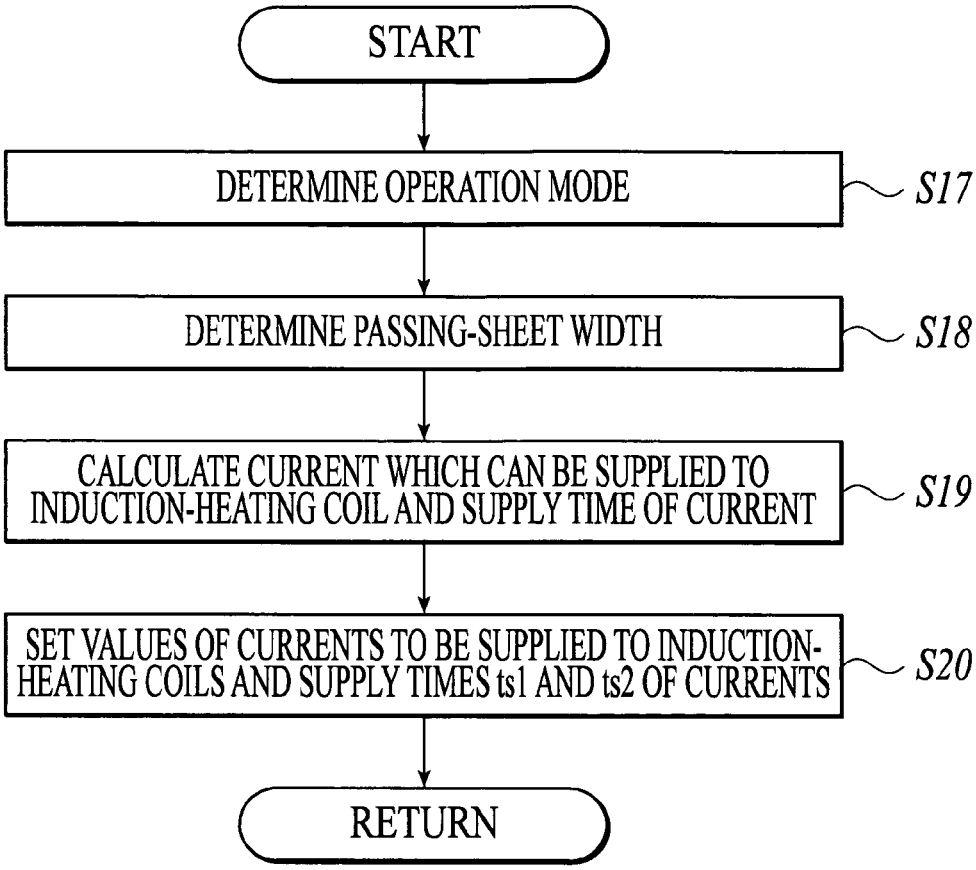
FIG. 9 is an operation flow for current-value setting and supply-time setting in embodiment 3.

FIG. 9 shows an operation flow for current setting and supply time setting in the present embodiment 3.

In the case of the flow in FIG. 9, the current value is set by considering a passing-sheet region (hereafter referred to as the passing-sheet width) of a recording material P on the heating roller 10 in accordance with the passing-sheet size of the recording material P to be passed through the heating roller 10. Therefore, the flow in FIG. 9 is a flow formed by adding a passing-sheet-width determination flow to the flow in FIG. 8.

First, the present operation mode of the image forming apparatus 1 is determined by obtaining the information on the voltage and the frequency of the power supply section of the image forming apparatus 1 (step S17). Moreover, the passing-sheet width is determined in accordance with the passing-sheet-size signal sent from the operating section 107 or the passing-sheet-size signal sent from the sheet size sensor 108 (step S18).

The current value which can be supplied to the induction-heating coil and the supply time of the current are calculated by referring to the determined operation mode and the passing-sheet width, and the current values and the supply times of the currents respectively stored in the current-value data table 204*a* for each operation mode and the supply-time data table 204*b* for each operation mode (step S19). The current values to be supplied to the first induction-heating coil 111 and the second induction-heating coils 112 and 112*b* and the supply times ts1 and ts2 of the currents are set respectively in accordance with the calculated current value and the calculated supply time of the current (step S20). Thereby, the driving-current is supplied to the first induction-heating coil 111 and the second induction-heating coils 112*a* and 112*b* in accordance with a current value and the supply time of the current set in view of the operation mode and the passing sheet width based on the passing-sheet size.

In the current-value data table 204*a* for each operation mode, the current value is set based on the operation mode and the passing-sheet width. For example, in the case that the operation mode is the image forming mode and the A4 sized recording material P is passed in the state that the passing-sheet direction and the longitudinal direction thereof are perpendicularly crossed each other (in the case of the passing-sheet width W1), the values of the driving-currents to be supplied to the first induction-heating coil 111 and the second induction-heating coils 112*a* and 112*b* are set to the same value each other in the current-value data table 204*a* for each operation mode, in order to uniform the whole temperature distribution in the axial direction of the heating roller 10. Further, in the case that the operation mode is the image forming mode and the A4 sized recording material P is passed in the state that the passing-sheet direction and the longitudinal direction thereof are parallel each other (in the case of the passing-sheet width W2), the value of the driving-current to be supplied to the second induction-heating coils 112*a* and 112*b* is set lower than that to be supplied to the first induction-heating coil 111 in the current-value data table 204*a* for each operation mode, because the temperature distribution in the axial direction of the heating roller 10 is acceptable if the temperature of the passing-sheet width W2 is a fixable temperature.

In the supply-time data table 204*b* for each operation mode, the ratio of the supply times of currents between the first induction-heating coil 111 and the second induction-heating coils 112*a* and 112*b* is set so as to be 1:1 in order to uniform the whole temperature distribution in the axial direction of the heating roller 10 in the case that the operation mode is the warm-up mode. Moreover, in the case that the operation mode is the image forming mode, when the A4 sized recoding material P is passed in the state that the longitudinal direction and the passing-sheet direction of the material P are parallel each other, the passing-sheet width is regarded as W1. In this case, the temperature distribution in the axial direction of the heating roller 10 is acceptable when the temperature of the passing-sheet width W1 is a fixable temperature. Therefore, the ratio of the supply times of the currents between the first induction-heating coil 111 and the second induction-heating coils 112*a* and 112*b* is set so as to be 3:1.

A calorific value (calorific density) at the same current value depends on specifications of the first induction-heating coil 111 and the second induction-heating coils 112*a* and 112*b*. Therefore, the above ratio of the supply times of the currents is not always obtained. It is preferable to set the supply-time data table 204*a* for each operation mode in accordance with the specification of an induction-heating coil to be used.

By changing the current values every passing-sheet width in accordance with the passing-sheet size of the recording material P, it is possible to prevent the value of driving-current supplied for each passing-sheet width from being excessive or insufficient, supply an optimum current, uniformly heat the heating roller 10, and moreover decrease a heating time. Thus, efficient heating is realized.

Moreover, by changing the supply time of the current to each induction-heating coil in accordance with the passing-sheet width, it is possible to quickly raise the fixing temperature of the heating roller every passing-sheet width, uniformly heat the heating roller 10, moreover decrease the heating time, and efficient heating can be realized.

[Embodiment 4]

Because the configuration of an image forming apparatus 1 and a longitudinal cross section of the heating roller 10 of the present embodiment 4 are the same as those of the embodiment 1, it is omitted to illustrate and describe them. Moreover, the control configuration of an induction-heating fixing apparatus 40 of the embodiment 4 is the same as that of the embodiment 2 except that a control member 300 is provided instead of the control member 200. Therefore, it is omitted to illustrate and describe the control configuration.

Figure 10:
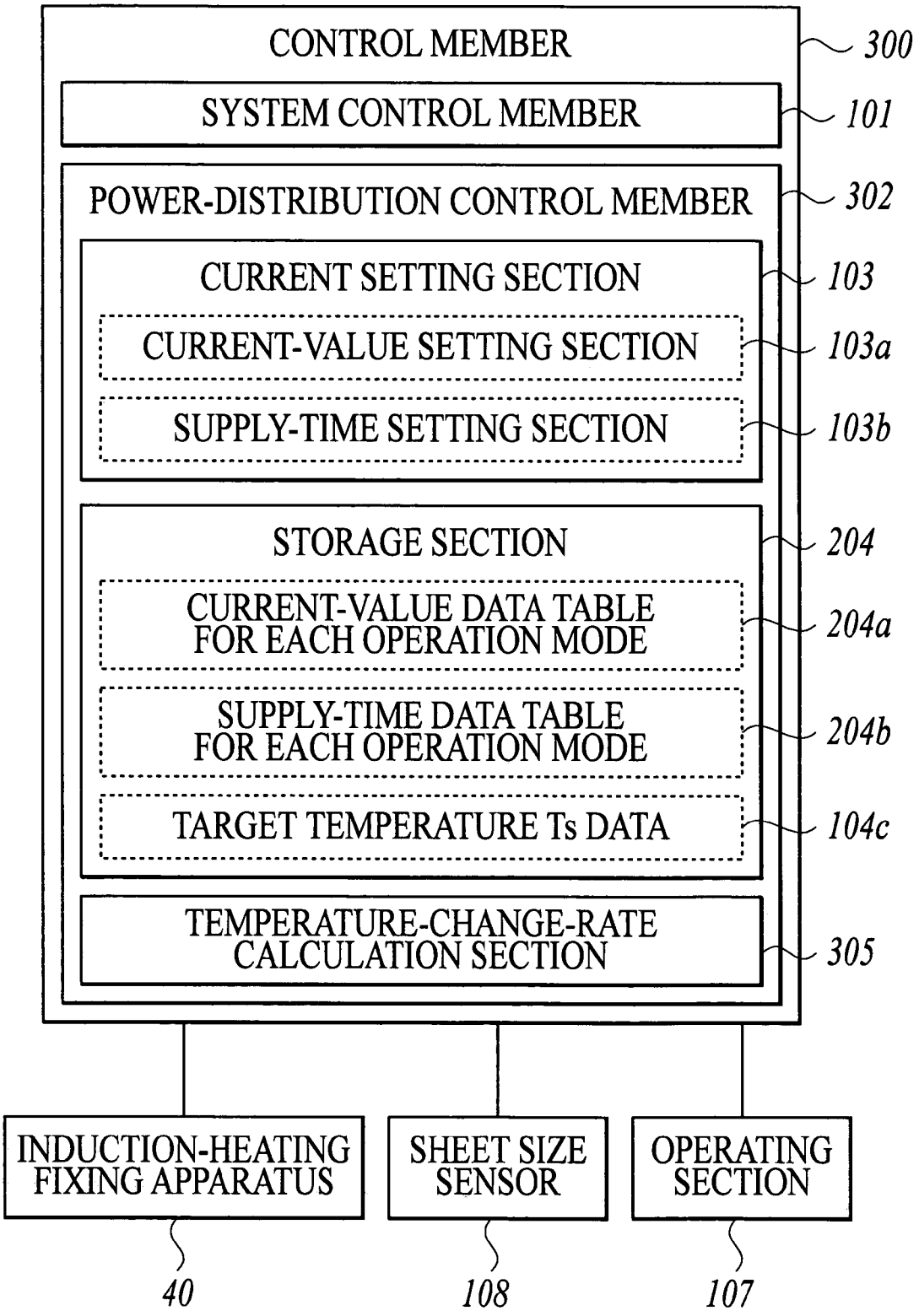
FIG. 10 is a control block diagram of control member 300 of embodiment 4.

FIG. 10 shows a control block diagram of the control member 300 of the present embodiment 4.

In FIG. 10, the configuration of the control member 300 of the embodiment 4 is the same as the configuration of the control member 200 of the embodiment 2 except that a power-distribution control member 302 comprises a temperature-change-rate calculation section 305. Therefore, it is omitted to describe the configuration.

The power-distribution control member 302 reads out the current-value setting section 103*a* set to the supply-time setting section 103*b* set in the current setting section 103. Then the power-distribution control member 302 sets the current values to be supplied to the first induction-heating coil 111 and the second induction-heating coils 112*a* and 112*b* in accordance with the current-value data table 204*a* for each operation mode of the storage section 204 and conditions such as the voltage and the frequency of an AC power supply section. Further, the power-distribution control member 302 sets the supply time of the current in accordance with the supply-time data table 204*b* for each operation mode and the temperature-change-rate calculation section 305. Moreover, the power-distribution control member 302 compares the first detection temperature T1 with the second detection temperature T2, determines and selects the induction-heating coil having a lower detection temperature, and controls power distribution in accordance with the target temperature Ts.

Moreover, the power-distribution control member 302 recognizes the passing-sheet width in accordance with the passing-sheet-size signal sent from the operating section 107 and the passing-sheet-size signal sent from the sheet size sensor 108.

The supply-time setting section 103*b* sets the supply times of currents for the first induction-heating coil 111 and the second induction-heating coils 112*a* and 112*b* in accordance with temperature change rates T1*dt* and T2*dt* calculated by a temperature-change-rate calculation section 305 for calculating change widths of the first and second detection temperatures T1 and T2 for unit time (that is, first and second temperature change rates T1*dt* and T2*dt*) and in accordance with the supply-time data table 204*b* for each operation mode.

<Control Operation of Driving Current>

Next, the operations of the present embodiment 4 will be described below.

A control operation flow of the driving-current to be supplied to the induction-heating coil in the present embodiment 4 is a flow formed by adding subroutines for the current-value setting and the supply-time setting to step S1 in the flow in FIG. 5 shown in the embodiment 1. Then a basic flow other than the above flow is the same as the flow in FIG. 5, the description of the basic flow is omitted.

<Current Value Setting and Supply Time Setting>

Figure 11:
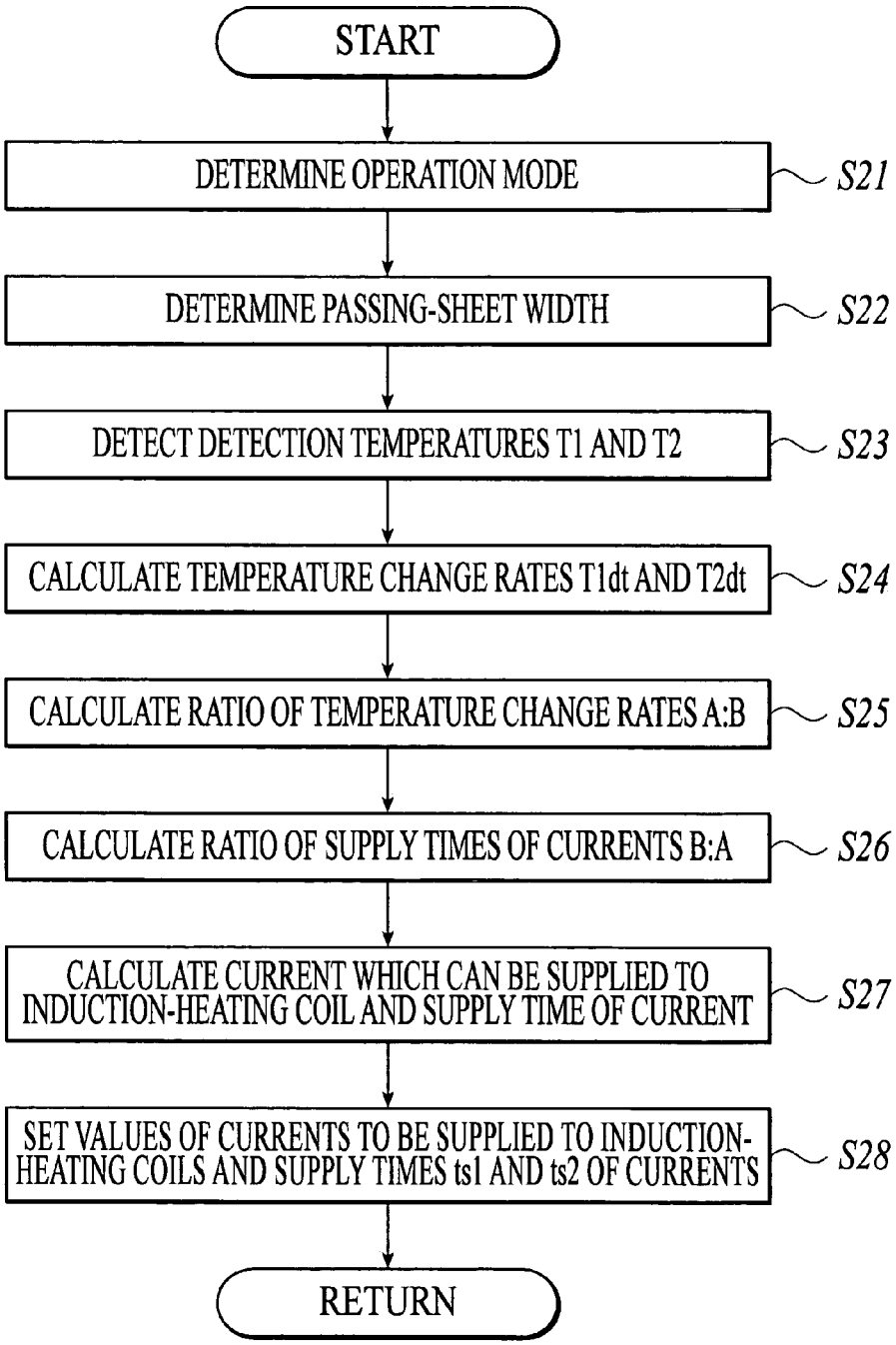
FIG. 11 is an operation flow for current-value setting and supply-time setting in the embodiment 4.

FIG. 11 shows an operation flow for the current-value setting and the supply-time setting in the present embodiment 4.

First, the information on the voltage and the frequency of the power supply section of the image forming apparatus 1 are obtained, and the present operation mode of the image forming apparatus 1 is determined (step S21). Moreover the passing-sheet width is determined based on the passing-sheet-size signal sent from the operating section 107 or the passing-sheet-size signal sent from the sheet size sensor 108 (step S22).

The first detection temperature T1 is detected by the first temperature sensor 121, the second detection temperature T2 is detected by the second temperature sensor 122, and the temperatures T1 and T2 are output to the control member 300 (step S23).

As for the first detection temperature T1 and the second detection temperature T2 input to the control member 300, a first temperature change rate T1*dt* of the first detection temperature T1 and a second temperature change rate T2*dt* of the second detection temperature T2 are calculated in the temperature-change-rate calculation section 305 (step S24). Then the ratio between the temperature change rates T1*dt* and T2*dt* is calculated (step S25).

When the component of the first temperature change rate T1*dt* of the ratio between the temperature change rates is defined as A and the component of the second temperature change rate T2*dt* is defined as B, it is possible to express the ratio between the temperature change rates as A:B. The ratio between the reciprocal 1/A of the component A of the first temperature change rate T1*dt* of the ratio between the temperature change rates and the reciprocal 1/B of the component B of the second temperature change rate T2*dt* is 1/A:1/B=B:A and the ratio between these reciprocals is calculated as the ratio of the supply times of the currents between the first induction-heating coil 111 and the second induction-heating coils 112*a* and 112*b* (step S26).

The current value which can be supplied to the induction-heating coil and the supply time of the current are calculated by referring to the calculated ratio of the supply times of the currents, the determined operation mode and the passing-sheet width, and the current values and the supply times of the currents respectively stored in the current-value data table 204*a* for each operation mode and the supply-time data table 204*b* for each operation mode (step S27). The current values to be supplied to the fist induction-heating coil 111 and the second induction-heating coils 112*a* and 112*b* and the supply times ts1 and ts2 of the currents are set respectively in accordance with the calculated current value and the calculated supply time of the current (step S28).

For example, when the temperature change rate T1*dt* detected by the first temperature sensor 121 is 5° C./s and the temperature change rate T2*dt* detected by the second temperature sensor 122 is 5° C./s, the ratio between the temperature change rates is 5° C./s:5° C./s=1:1. Therefore, the ratio between the driving-current supply times is 1:1. Therefore, the supply times of driving-currents to the first induction-heating coil 111 and the second induction-heating coils 112*a* and 112*b* are set to the same value each other.

Moreover, when the temperature change rate T1*dt* detected by the first temperature sensor 121 is 7° C./s and the ratio between temperature change rates when the temperature change rate T2*dt* detected by the second temperature sensor 122 is 3° C./s, the ratio between the temperature change rates is 7° C./s:3° C./s=7:3. Therefore, the ratio of the driving-current supply times is 3:7. Therefore, the supply times of the currents for the first induction-heating coil 111 and the second induction-heating coils 112*a* and 112*b* are respectively set in accordance with the ratio of the driving-current supply times.

When the temperatures of the heating rollers facing the plurality of induction-heating coils are uniformed by setting and changing the supply time of the current to each induction-heating coil in accordance with the ratio between the change rates of the temperatures detected by the temperature sensors, it is possible to quickly clear the temperature difference between the heating rollers caused by induction-heating coils and decrease the heating time. Moreover, it is possible to prevent a supply current generated due to power distribution from being excessive or insufficient and efficiently heat the heating roller.

[Embodiment 5]

Because a configuration of an image forming apparatus 1 and a longitudinal cross section of the heating roller 10 of the present embodiment 5 are the same as those of the embodiment 1, it is omitted to illustrate and describe them. Moreover, a control configuration of an induction-heating fixing apparatus 40 of the embodiment 4 is the same as that of the embodiment 2 except that a control member 400 is provided instead of the control member 200. Therefore, it is omitted to illustrate and describe the control configuration.

Figure 12:
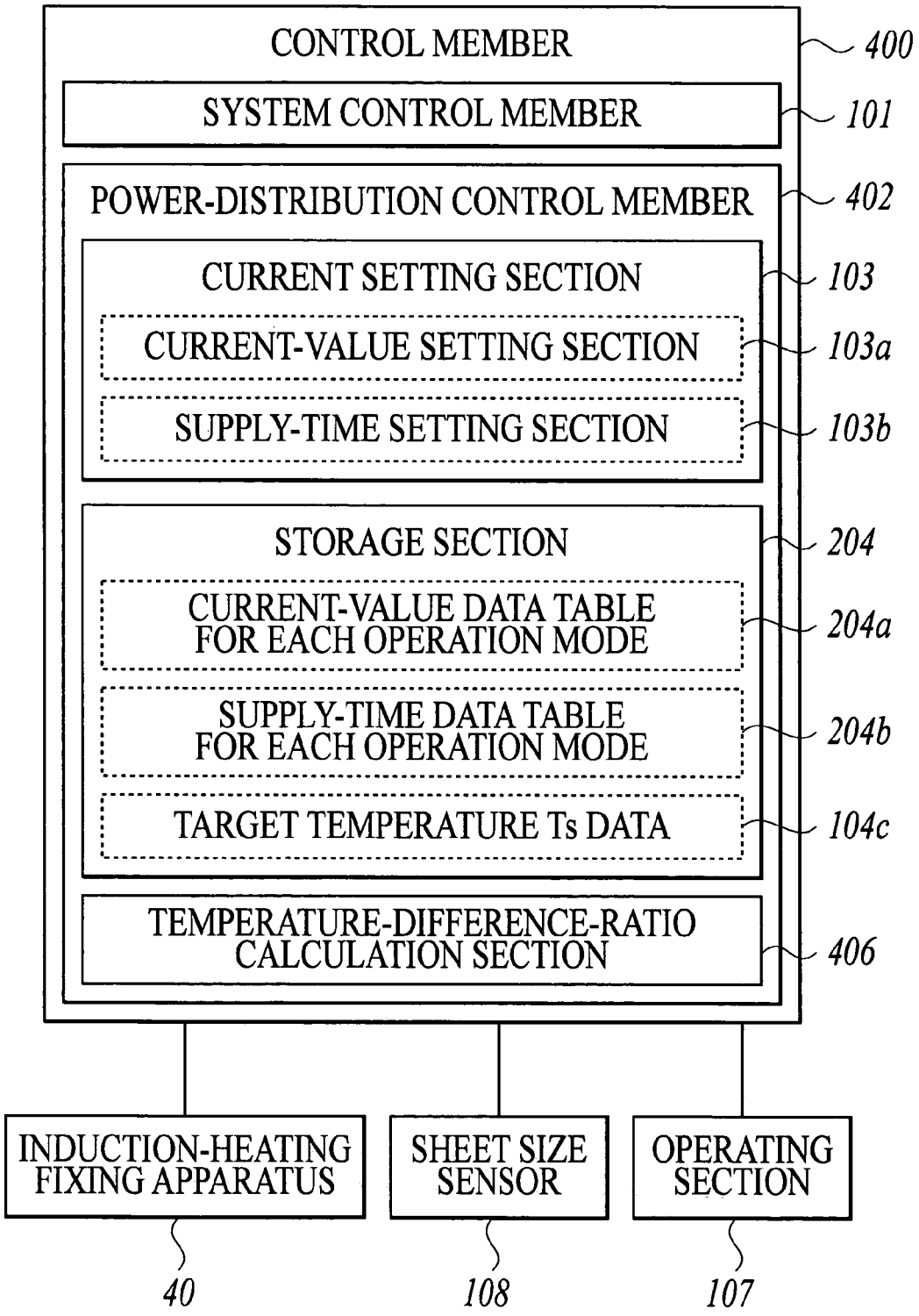
FIG. 12 is a control block diagram of control member 400 of embodiment 5.

FIG. 12 shows a control block diagram of the control member 400 of the present embodiment 5.

In FIG. 12, a power-distribution control member 402 has a temperature-difference-ratio calculation section 405 but description is omitted because configuration other than the section 405 is the same as that of the embodiment 2.

The power-distribution control member 402 reads the current-value setting section 103*a* and the supply-time setting section 103*b*, sets the current values to be supplied to the first induction-heating coil 111 and the second induction-heating coils 112*a* and 112*b* in accordance with the current-value data table 204*a* for each operation mode of the storage section 204 and conditions such as the voltage and frequency of an AC power-supply section, and sets supply times of the currents in accordance with the supply-time data table 204*b* for each operation mode and the temperature-difference-ratio calculation section 405. Moreover, the control member 402 compares the first detection temperature T1 with the second detection temperature T2, determines and selects an induction-heating coil having a lower detection temperature, and controls power distribution in accordance with the target temperature Ts.

Furthermore, the control member 402 recognizes the passing-sheet width in accordance with the passing-sheet-size signal sent from the operating section 107 and the passing-sheet-size signal sent from the sheet size sensor 108.

The supply-time setting section 103*b* sets supply times of currents for the first induction-heating coil 111 and second induction-heating coils 112*a* and 112*b* in accordance with a temperature difference rate calculated by the temperature-difference-ratio calculation section 405 and the supply-time data table 204*b* for each operation mode.

<Control Operation of Driving Current>

Next, the operations of the present embodiment 4 will be described.

A control operation flow of a driving-current to be supplied to an induction-heating coil in the present embodiment 4 is a flow formed by adding subroutines for the current-value setting and the supply-time setting to Step S1 in the flow in FIG. 5 shown in the embodiment 1. Then a basic flow other than the above flow is the same as the flow in FIG. 5, the description of the basic flow is omitted.

<Current Value Setting and Supply Time Setting>

Figure 13:
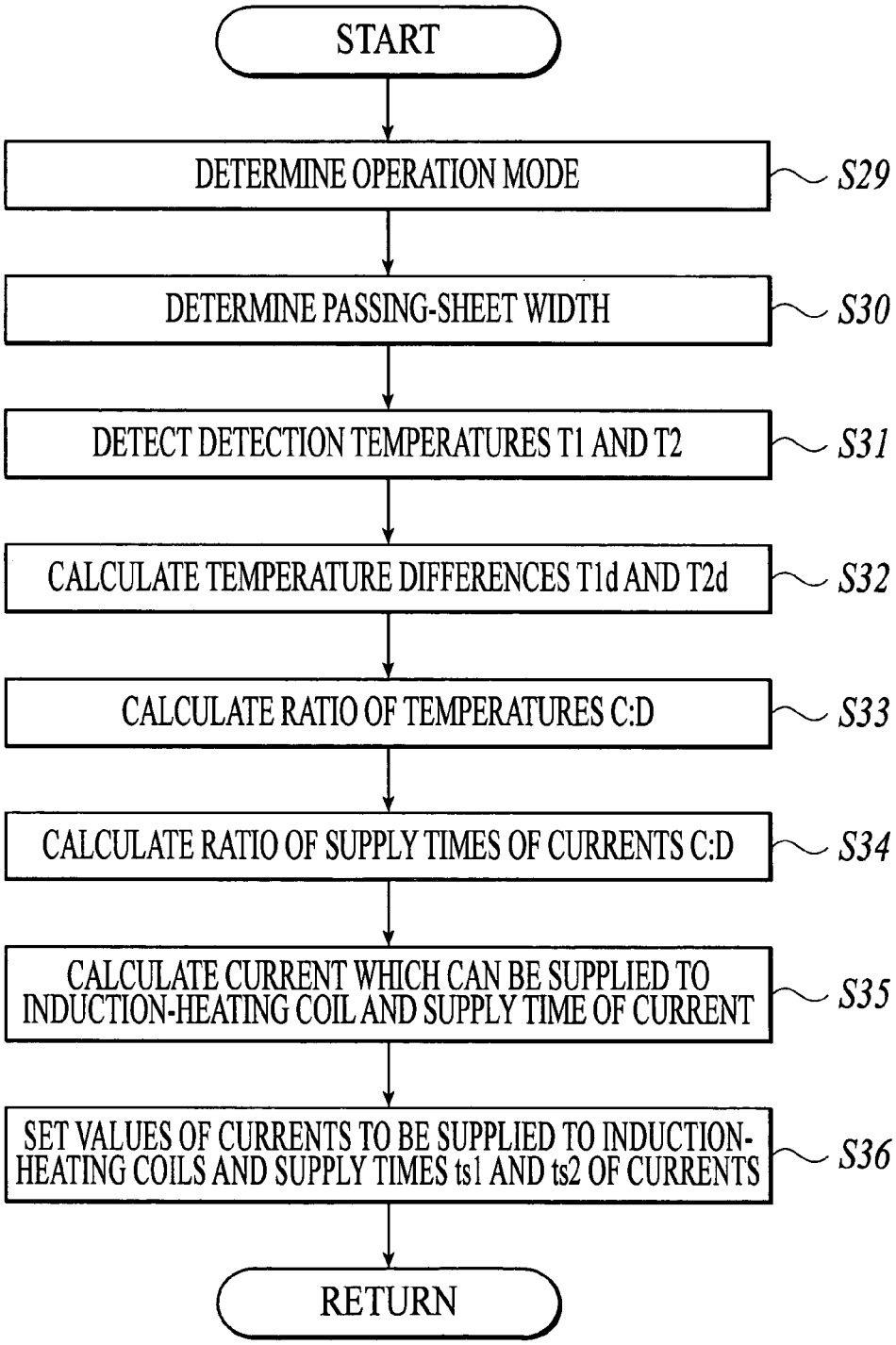
FIG. 13 is an operation flow for current-value setting and supply-time setting in the embodiment 5.

FIG. 13 shows an operation flow for current value setting and supply time setting in the present embodiment 5.

First, the information on the voltage and frequency of the power supply section of the image forming apparatus 1 are obtained, and the present operation mode of the image forming apparatus 1 is determined (step S29). Moreover the passing-sheet width is determined based on the passing-sheet-size signal sent from the operating section 107 and the passing-sheet-size signal sent from the sheet size sensor 108 (step S30).

The first detection temperature T1 is detected by the first temperature sensor 121, the second detection temperature T2 is detected by the second temperature sensor 122, and the temperatures T1 and T2 are output to the control member 400 (step S31).

As for the first detection temperature T1 and the second detection temperature T2 input to the control member 400, a detection temperature difference T1*d* between the input first detection temperature T1 and the target temperature Ts and a detection temperature difference T2*d* between the input second detection temperature T2 and the target temperature Ts are calculated by the temperature-difference-ratio calculation section 405 (step S32) and the ratio between the first detection temperature difference T1*d* and the second detection temperature difference T2*d* is calculated (step S33).

When the first detection temperature difference T1*d* component of the ratio of the temperature differences is defined as C and the second detection temperature difference T2*d* component of the ratio is defined as D, it is possible to express the ratio of the temperature differences as C:D. The calculated temperature difference ratio is calculated as the ratio of supply times of currents between the first induction-heating coil 111 and the second induction-heating coils 112*a* and 112*b* (step S34).

The current value which can be supplied to the induction-heating coil and the supply time of the current are calculated by referring to the calculated supply-time ratio, the determined operation mode, the passing-sheet width, and the current values and the supply times of the currents stored in the current-value data table 204*a* for each operation mode and the supply-time data table 204*b* for each operation mode (step S35). The current values to be supplied to the first induction-heating coil 111 and the second induction-heating coils 112*a* and 112*b* and the supply times ts1 and ts2 of the currents are set in accordance with the calculated current value and the calculated supply time of the current (step S36).

For example, when the target temperature Ts of the heating roller 10 is 200° C. and the detection temperature T1 detected by the first temperature sensor 121 is 20° C., the first detection temperature difference T1*d* is calculated as 180° C. and when the detection temperature T2 detected by the second temperature sensor 122 is 20° C., the second detection temperature difference T2*d* is calculated as 180° C. Because the ratio of the temperature differences becomes 180° C.:180° C.=1:1, the ratio of supply times of currents becomes 1:1. Therefore, the times for supplying driving-currents to the first induction-heating coil 111 and the second induction-heating coils 112*a* and 112*b* are set to the same value each other.

Moreover, when the target temperature Ts of the heating roller 10 is 200° C. and the detection temperature T1 detected by the first temperature sensor 121 is 150° C., the first detection temperature difference T1*d* is calculated as 50° C. and when the detection temperature T2 detected by the second temperature sensor 122 is 175° C., the second detection temperature difference T2*d* is calculated as 25° C. Because the ratio of the temperature differences becomes 50° C.:25° C.=2:1, the ratio of the supply times of the currents becomes 2:1. Therefore, the supply time of the current for the first induction-heating coil 111 is set to twice as long as that for the second induction-heating coils 112*a* and 112*b*.

The supply time of the current for each induction-heating coil is set and changed in accordance with the ratio of the temperature differences between the detection temperatures detected by the temperature sensor and the target temperature. Therefore, when uniforming the temperatures of the heating rollers facing the plurality of induction-heating coils, it is possible to quickly clear the temperature difference between the heating rollers caused by the induction-heating coils and decrease a heating time. Moreover, it is possible to prevent a supply current generated due to power distribution from being excessive or insufficient and it is possible to efficiently heat the heating roller.

No. Tokugan 2003-196477 filed on Jul. 14, 2003, and No. Tokugan 2004-057725 filed on Mar. 2, 2004 which is the application claiming the priority of the previous application, including specification, claims, drawings and summary are incorporated herein by reference in its entirety.

What is claimed is:

1. An induction-heating fixing apparatus comprising:

a heating member for fixing a toner image to a recording material carrying the toner image by heating the toner image;

an induction-heating coil divided into a plurality of coils and comprising a first induction-heating coil and a second induction-heating coil adjacent to each other; and a power-distribution control member for controlling power distribution by supplying a driving-current to the plurality of induction-heating coils in order to heat the heating member, wherein the power-distribution control member comprises a determining section for selecting whether to supply the driving-current to the first induction-heating coil or the second induction-heating coil.

2. The induction-heating fixing apparatus of claim 1, wherein the driving-currents to be supplied to the plurality of induction-heating coils have the same current value each other.

3. The induction-heating fixing apparatus of claim 1, further comprising:

a first temperature sensor for detecting a temperature of the heating member corresponding to the first induction-heating coil; and a second temperature sensor for detecting a temperature of the heating member corresponding to the second induction-heating coil, wherein the determining section selects the first induction-heating coil or the second induction-heating coil in accordance with detection temperatures detected by the first temperature sensor and the second temperature sensor.

4. The induction-heating fixing apparatus of claim 1, wherein the power-distribution control member controls supply of the driving-current to each of the induction-heating coils adjacent to each other so as to raise the driving-current to be supplied to one of the adjacent induction-heating coils when the driving-current to be supplied to the other of the adjacent induction-heating coils falls.

5. The induction-heating fixing apparatus of claim 1, further comprising:

a first temperature sensor for detecting a temperature of the heating member corresponding to the first induction-heating coil; and a second temperature sensor for detecting a temperature of the heating member corresponding to the second induction-heating coil, wherein the power-distribution control member performs control so as to adjust a time for supplying the driving-current to each of the induction-heating coils in accordance with a change rate of a detection temperature detected by each of the temperature sensors.

6. The induction-heating fixing apparatus of claim 1, further comprising:

a first temperature sensor for detecting a temperature of the heating member corresponding to the first induction-heating coil; and a second temperature sensor for detecting a temperature of the heating member corresponding to the second induction-heating coil, wherein the power-distribution control member performs control so as to adjust a rate of a time for supplying the driving-current to each of the induction-heating coils in accordance with a difference between a predetermined target temperature and a detection temperature detected by each of the temperature sensors.

7. An induction-heating fixing apparatus comprising:

a heating member for fixing a toner image to a recording material carrying the toner image by heating the toner image;

an induction-heating coil divided into a plurality of coils and comprising a first induction-heating coil and a second induction-heating coil adjacent to each other; and a power-distribution control member for controlling power distribution by supplying a driving-current to the plurality of induction-heating coils in order to heat the heating member, wherein the power-distribution control member performs control so as not to supply the driving-current to the second induction-heating coil when the driving-current is supplied to the first induction-heating coil or so as not to supply the driving-current to the first induction-heating coil when the driving-current is supplied to the second induction-heating coil.

8. An image forming apparatus comprising:

an image carrying body for carrying a toner image;

a transfer member for transferring the toner image carried by the image carrying body to a recording material; and an induction-heating fixing apparatus for fixing the toner image to the recording material carrying the toner image, the induction-heating fixing apparatus comprising a heating member for fixing the toner image to the recording material carrying the toner image by heating the toner-image, an induction-heating coil divided into a plurality of coils and comprising a first induction-heating coil and a second induction-heating coil adjacent to each other, and a power-distribution control member for controlling power distribution by supplying a driving-current to the plurality of induction-heating coils in order to heat the heating member, wherein the power-distribution control member comprises a determining section for selecting whether to supply the driving-current to the first induction-heating coil or the second induction-heating coil.

9. The image forming apparatus of claim 8, wherein the driving-currents to be supplied to the plurality of induction-heating coils have the same current value each other.

10. The image forming apparatus of claim 8, further comprising:

a first temperature sensor for detecting a temperature of the heating member corresponding to the first induction-heating coil; and a second temperature sensor for detecting a temperature of the heating member corresponding to the second induction-heating coil, wherein the determining section selects the first induction-heating coil or the second induction-heating coil based on detection temperatures detected by the first temperature sensor and the second temperature sensor.

11. The image forming apparatus of claim 8, wherein the power-distribution control member controls supply of the driving-current to each of the induction-heating coils adjacent to each other so as to raise the driving-current to be supplied to one of the adjacent induction-heating coils when the driving-current to be supplied to the other of the adjacent induction-heating coils falls.

12. The image forming apparatus of claim 8, further comprising:

a first temperature sensor for detecting a temperature of the heating member corresponding to the first induction-heating coil; and a second temperature sensor for detecting a temperature of the heating member corresponding to the second induction-heating coil, wherein the power-distribution control member performs control so as to adjust a time for supplying the driving-current to each of the induction-heating coils in accordance with a change rate of a detection temperature detected by each of the temperature sensors.

13. The image forming apparatus of claim 8, further comprising:

a first temperature sensor for detecting a temperature of the heating member corresponding to the first induction-heating coil; and a second temperature sensor for detecting a temperature of the heating member corresponding to the second induction-heating coil, wherein the power-distribution control member performs control so as to adjust a rate of a time for supplying the driving-current to each of the induction-heating coils in accordance with a difference between a predetermined target temperature and a detection temperature detected by each of the temperature sensors.

14. The image forming apparatus of claim 8, wherein the driving-currents to be supplied to the plurality of induction-heating coils are changed in accordance with an operation mode of the image forming apparatus.

15. The image forming apparatus of claim 14, wherein the operation mode comprises at least a plurality of operation modes selected out of an image forming mode, a standby mode, and an energy saving mode.

16. The image forming apparatus of claim 8, wherein the power-distribution control member performs control so as to supply the driving-current, which is determined in advance corresponding to a passing-sheet size of the recording material, to each of the induction-heating coils.

17. The image forming apparatus according to claim 8, wherein the power-distribution control member performs control so as to adjust a time for supplying the driving-current, which is determined in advance corresponding to a passing-sheet size of the recording material, to each of the induction-heating coils.

18. An image forming apparatus, comprising:

an image carrying body for carrying a toner image;

a transfer member for transferring the toner image carried by the image carrying body to a recording material; and an induction-heating fixing apparatus for fixing the toner image to the recording material carrying the toner image, the induction-heating fixing apparatus comprising a heating member for fixing the toner image to the recording material carrying the toner image by heating the toner image, an induction-heating coil divided into a plurality of coils and comprising a first induction-heating coil and a second induction-heating coil adjacent to each other, and a power-distribution control member for controlling power distribution by supplying a driving-current to the plurality of induction-heating coils in order to heat the heating member, wherein the power-distribution control member performs control so as not to supply the driving-current to the second induction-heating coil when the driving-current is supplied to the first induction-heating coil or so as not to supply the driving-current to the first induction-heating coil when the driving-current is supplied to the second induction-heating coil.

* * * * *